US011060295B2

(12) United States Patent
Kovacs et al.

(10) Patent No.: US 11,060,295 B2
(45) Date of Patent: Jul. 13, 2021

(54) SNOW FENCE FOR A STRUCTURE HAVING VARYING ROOF TYPES

(71) Applicant: PMC Industries, Inc., Plainville, CT (US)

(72) Inventors: Tamas Kovacs, Burlington, CT (US); Robert Mercier, Newington, CT (US)

(73) Assignee: PMC INDUSTRIES, INC., Plainville, CT (US)

( * ) Notice: Subject to any disclaimer, the term of this patent is extended or adjusted under 35 U.S.C. 154(b) by 0 days.

(21) Appl. No.: 16/745,333

(22) Filed: Jan. 16, 2020

(65) Prior Publication Data

US 2020/0224424 A1 Jul. 16, 2020

Related U.S. Application Data

(60) Provisional application No. 62/793,378, filed on Jan. 16, 2019.

(51) Int. Cl.
*E04D 1/10* (2006.01)
*E04D 13/04* (2006.01)
*E04D 13/10* (2006.01)

(52) U.S. Cl.
CPC ..... *E04D 13/10* (2013.01); *E04D 13/0481* (2013.01)

(58) Field of Classification Search
CPC ..... E04D 13/10; E04D 13/0481
USPC ..... 52/24
See application file for complete search history.

(56) References Cited

U.S. PATENT DOCUMENTS 1,925,263 A * 9/1933 Levow ..... E04D 13/10 52/25
2,079,768 A * 5/1937 Levow ..... E04D 13/10 52/25
4,110,597 A * 8/1978 Elmore ..... E04D 13/103 138/33
4,630,338 A * 12/1986 Osterland ..... F16B 5/123 24/293
5,074,093 A * 12/1991 Meadows ..... E04D 3/32 52/537

(Continued)

FOREIGN PATENT DOCUMENTS

DE 102018103044 A1 * 8/2019 ..... E04D 13/10

*Primary Examiner* — Patrick J Maestri
*Assistant Examiner* — Joseph J. Sadlon
(74) *Attorney, Agent, or Firm* — Damian Wasserbauer, Esq.; Wasserbauer Law LLC

(57) ABSTRACT

The present invention relates to a bar system for securing a snow fence to a membrane pad assembly connected to a structure. The bar system comprises a base bracket with an arm attachment portion having one or more openings and an arm bracket comprising one or more openings for operably connecting to the arm attachment portion using fasteners. At least one of the openings in the base bracket is configured to operably connect to the membrane pad assembly. At least one of the one or more openings in the arm bracket comprising an arcuate opening so as to allow movement along X,Y and rotational axis, e.g. horizontally, vertically and/or to allow the arm bracket to move between an open position and a closed position relative to the arm attachment portion so as to allow entry of a bar extrusion. The bar extrusion being secured by the fasteners in the one or more openings between the arm attachment portion of the base bracket and the arm bracket so as to hold snow, ice and other objects.

14 Claims, 20 Drawing Sheets

(56) References Cited

U.S. PATENT DOCUMENTS 5,465,510 A * 11/1995 Goodnough ..... E04D 13/106 294/54.5
5,566,513 A * 10/1996 Herren ..... E04D 13/076 210/474
5,581,955 A * 12/1996 Gleave ..... E04D 13/178 52/27
5,609,326 A * 3/1997 Stearns ..... E04D 13/10 182/45
5,617,678 A * 4/1997 Morandin ..... E04D 13/0725 248/48.2
5,845,435 A * 12/1998 Knudson ..... E04D 13/076 52/11
5,941,653 A * 8/1999 Cipriani ..... B60M 1/20 403/344
6,085,422 A * 7/2000 Hirabayashi ..... B23D 29/002 30/122
6,357,184 B1 * 3/2002 Alley ..... E04D 13/10 211/182
6,491,287 B1 * 12/2002 Savenok ..... E04F 11/181 256/19
6,602,016 B2 * 8/2003 Eckart ..... F16L 3/1033 403/110
6,959,512 B2 * 11/2005 Cobb ..... E04D 13/0481 219/213
7,028,437 B2 * 4/2006 Hauck ..... E04D 13/0445 52/11
7,140,152 B2 * 11/2006 Thaler ..... E04D 13/10 52/25
7,673,423 B2 * 3/2010 Podirsky ..... E04D 1/30 52/96
8,316,617 B2 * 11/2012 Krovats ..... F16L 55/035 52/746.11
8,857,108 B2 * 10/2014 Smeja ..... E04D 13/10 52/26
9,083,133 B2 * 7/2015 Hutchfield ..... H01R 43/042
9,765,526 B2 * 9/2017 Breyer ..... E04D 13/103
9,938,998 B2 * 4/2018 Krohn ..... F16B 5/0642
9,949,318 B2 * 4/2018 Whitcraft ..... H05B 3/34
10,293,769 B2 * 5/2019 Krohn ..... F16L 3/237
2014/0318032 A1 * 10/2014 McCarthy ..... E04D 13/10 52/24

* cited by examiner

SNOW FENCE FOR A STRUCTURE HAVING VARYING ROOF TYPES

FIELD OF THE INVENTION

The present invention relates to a roof fence and/or snow bar system for structures having varying roof types and, more particularly, a snow bar system comprising components of a bar having an attachment portion for an ice flag, base bracket, an arm bracket and fasteners that can be configured for numerous roof variations including corrugated roof, membrane roof, metal roof, flat roof and other low slope roofs to attach the system to the structure.

BACKGROUND OF THE INVENTION

Conventional systems have limitations that require use of multiple mounting clamps and brackets to support a snow retention system along lengths of the roof of the structure. These additional parts and cost to the overall system and time for installation such as, for example, typical installations have clamps supporting the retention bar (e.g. two-bar, three-bar, and other bars, that effectively constitute more cross members) with distances between 10 and 14 inches. This spacing provides suitable strength to the bar to resist the load force of the snow. For example, if the mounting clamps were spaced further apart, such conventional two-bar systems have a tendency to bend under the snow load, and once bent, these systems do not return to their original shape, thereby failing, and requiring seasonal replacement.

Consequently, there is a long felt need for a bar with more holding force than conventional systems that also can be effective on numerous low-slope roof types, for example, membrane roofs where a desired spacing of mounts is at least as large as 48" inches. There is also a need to provide a system having competitive costs to the consumer, whereby reduction of the number of rails is kept at a minimum for roofs approaching 60 feet from eave to ridge.

The present invention provides an extruded bar system with an ease of installation, improved strength of the bar, and an overall reduction in the total cost of the system.

SUMMARY OF THE INVENTION

It is an object of the invention to provide an extruded bar system with an ease of installation, improved strength of the bar, and an overall reduction in the total cost of the system. The bar system can be configured to form a snow fence operably connected to a membrane pad assembly secured to a structure.

The invention provides a bar system comprising a base bracket with an arm attachment portion having one or more openings and an arm bracket including one or more openings for operably connecting to the arm attachment portion using fasteners. At least one of the openings in the base bracket is configured to operably connect to the membrane pad assembly. At least one of the one or more openings in the arm bracket comprises an arcuate opening so as to allow movement along X,Y and rotational axes, e.g. horizontally, vertically and/or to allow the arm bracket to move between an open position and a closed position relative to the arm attachment portion so as to allow entry of a bar extrusion. The bar extrusion is secured by the fasteners in the one or more openings between the arm attachment portion of the base bracket and the arm bracket so as to hold snow, ice and other objects.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, showing certain aspects of the subject matter disclosed herein. Together with the description, these figures help explain some of the principles associated with the disclosed implementations, where.

DESCRIPTION OF THE EMBODIMENTS

Figure 1:
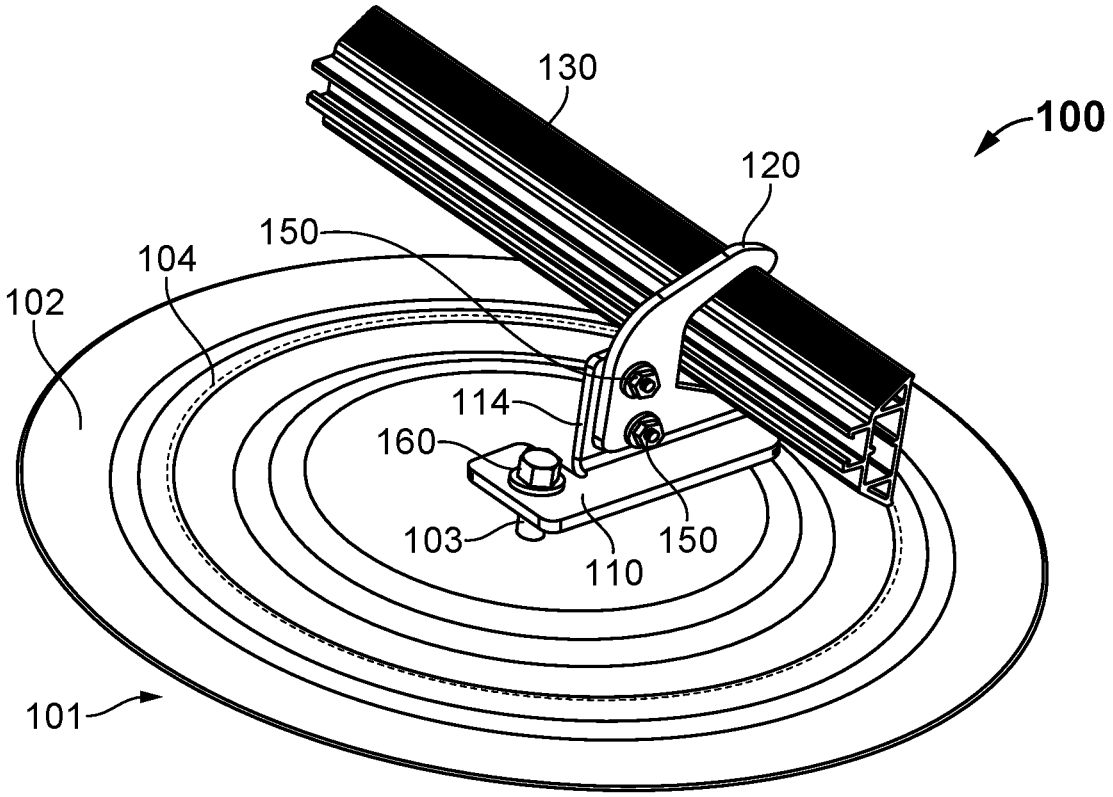
FIG. 1 is a perspective view illustrating the bar system with integral ice flag for low-slope roof structures according to the present invention.
Figure 2:
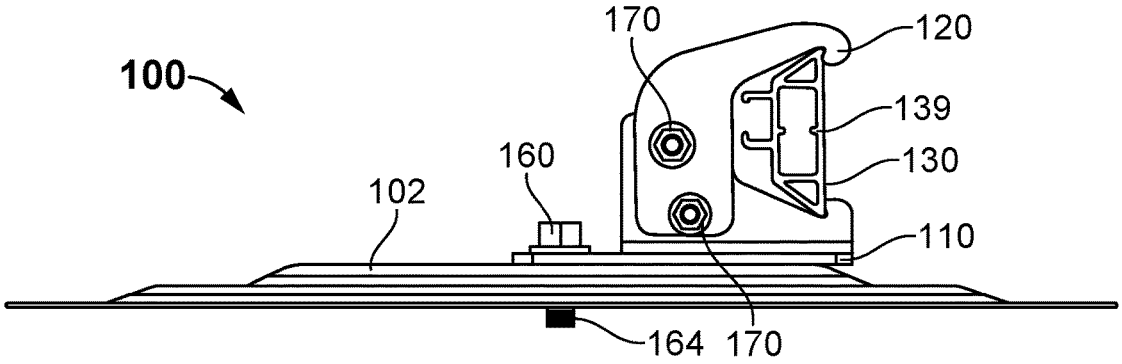
FIG. 2 is a right side view illustrating the bar system of the invention.
Figure 3:
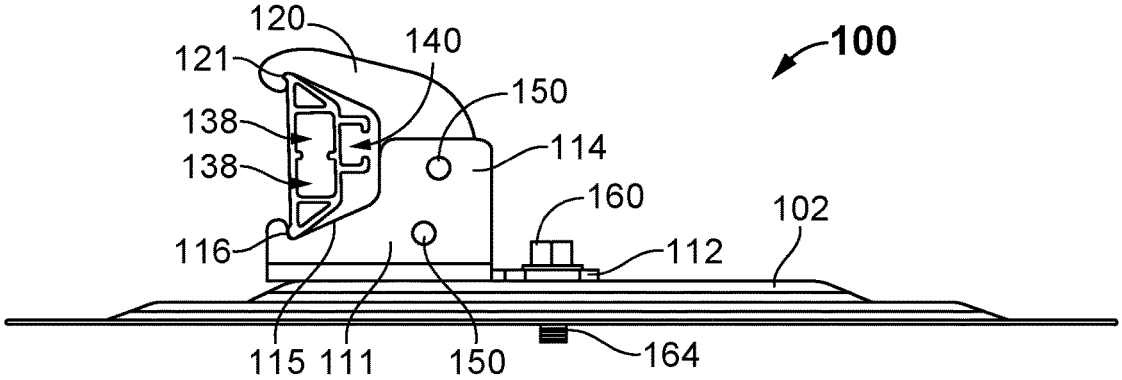
FIG. 3 is a left side view illustrating the bar system of the invention.
Figure 4:
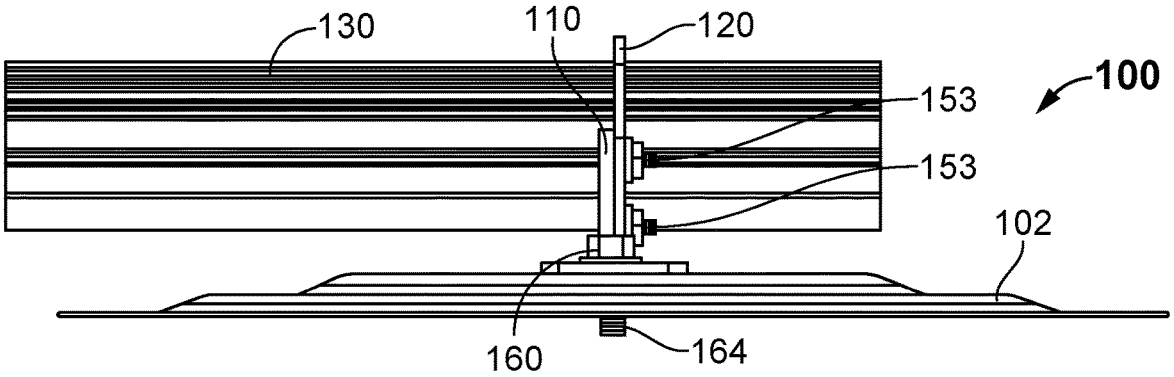
FIG. 4 is a rear view illustrating the bar system of the invention.
Figure 5:
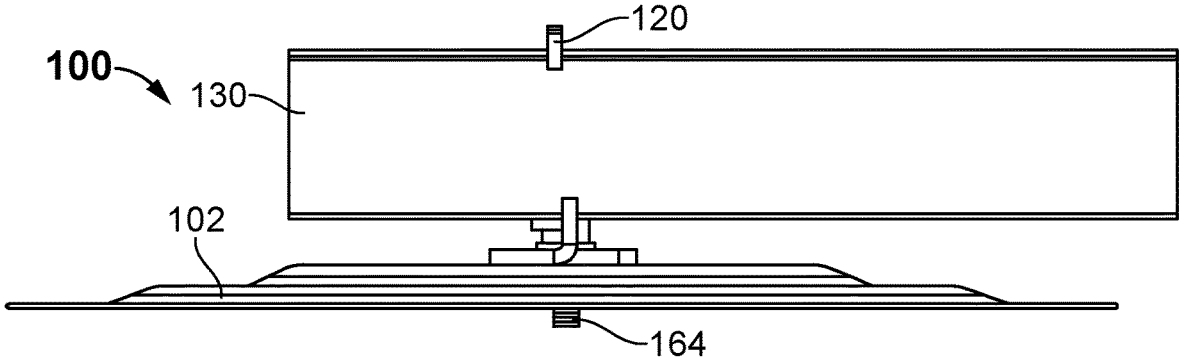
FIG. 5 is a front view illustrating the bar system of the invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

Figure 15:
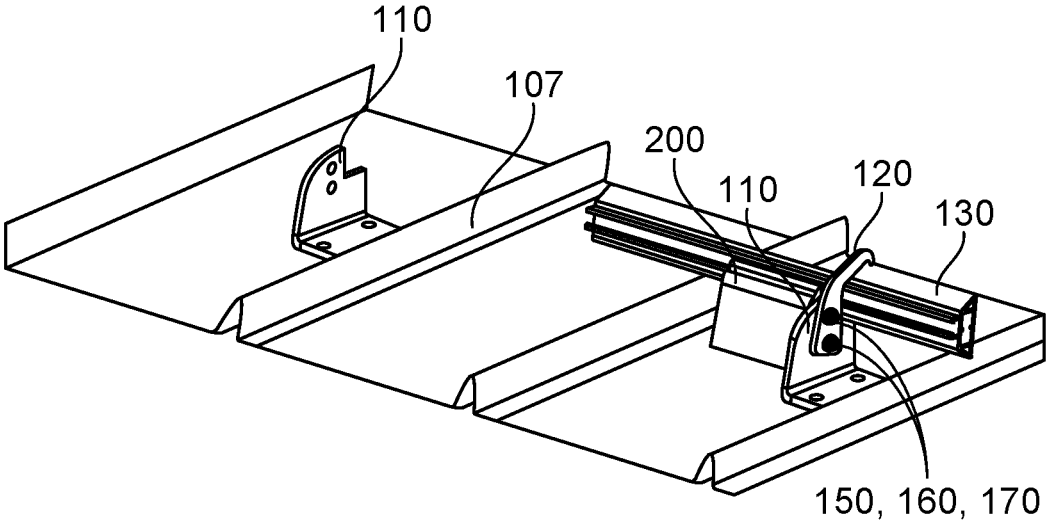
FIG. 15 is a perspective view illustrating the bar system with an ice flag for a standing seam metal roof structure.
Figure 16:
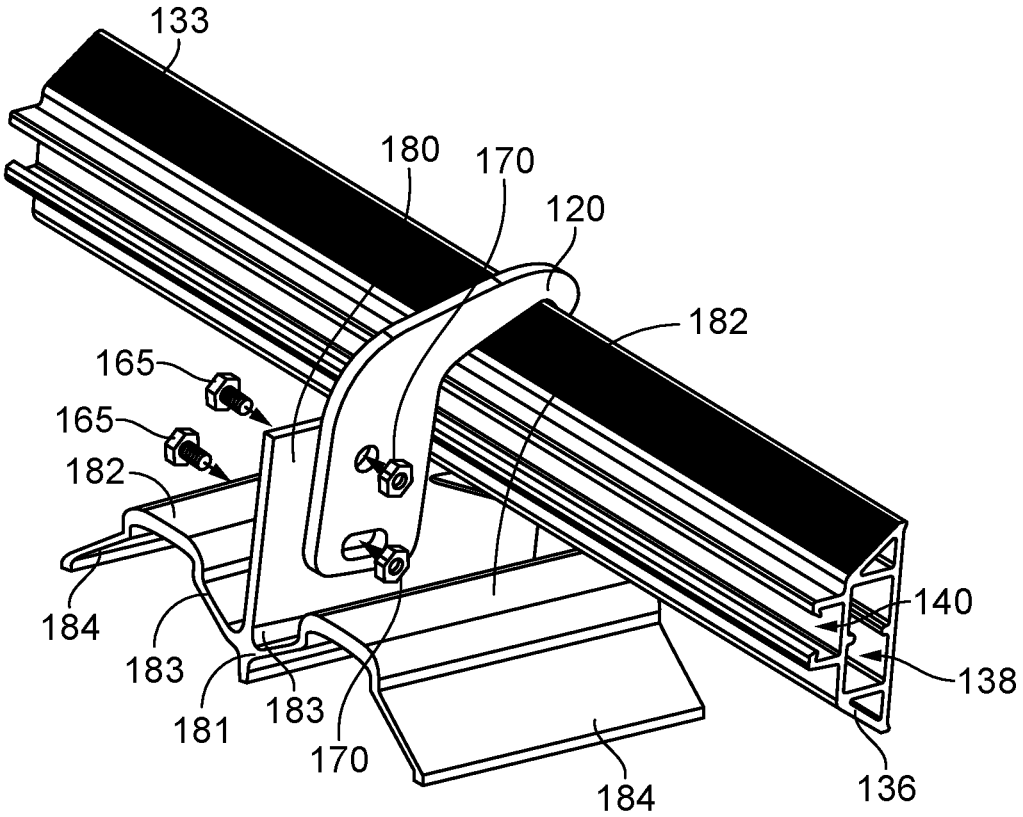
FIG. 16 is a perspective view illustrating a bar system with an ice flag for a corrugated roof structure.

Referring to FIGS. 1 through 51, a bar system 100 is disclosed for securing a snow bar extrusion 130 to a structure 101. The bar system 100 has a snow bar extrusion 130 configured with an ice flag slot to receive an ice flag 200. As illustrated in the embodiment of FIGS. 1 through 12A-12B, a membrane roof structure incorporates the bar system 100. As illustrated in another embodiment of FIGS. 13A-13B through 15, the bar system 100 has applications for metal roofs and, in particular, for a standing seam metal roof to attach the bar system 100 to the structure 101. As illustrated in yet another embodiment as is illustrated in FIG. 16, the bar system 100 has applications for corrugated panels so as to attach the bar system 100 to the structure 101. The invention of the bar system 100 is described herein in relation to low slope roofing structures such as corrugated panels, membrane roofing material, standing seam metal roofs and other low slope or relatively flat roofs on a structure; however, the invention is not intended to be limited to the embodiments described herein, as applications for other structures are contemplated for the bar system 100.

Referring to FIGS. 1 through 12A-12B, the bar system 100 is adapted to be attached to a structure 101 of a membrane roof using a membrane pad assembly 102. The membrane pad assembly 102 generally includes an aperture 103 in a plate 104 configured to extend through the membrane pad assembly 102 receiving a nut or fastener to secure assembly to the structure 101 such as by heating the membrane pad to adhere to the membrane roofing material. Numerous membrane pad assemblies 102 can be arranged on the structure 101 so as to create attachment points for a device. For example, the bar system 100 is suitable to attach a base bracket 110 to the membrane pad assembly 102 via the aperture 103 using a fastener 105 for securing the base bracket 110 to the structure 101. The base bracket 110 further includes the arm attachment portion 114 for attaching an arm bracket 120 thereto using suitable fasteners such as one or more stud fasteners 150 and a nut 170. A snow bar extrusion 130 can be received between the base bracket 110 and arm bracket 120 and secured in place by the stud fasteners and nuts 170 so as to form a snow retention system that can be configured to receive an ice flag 200.

Figure 34:
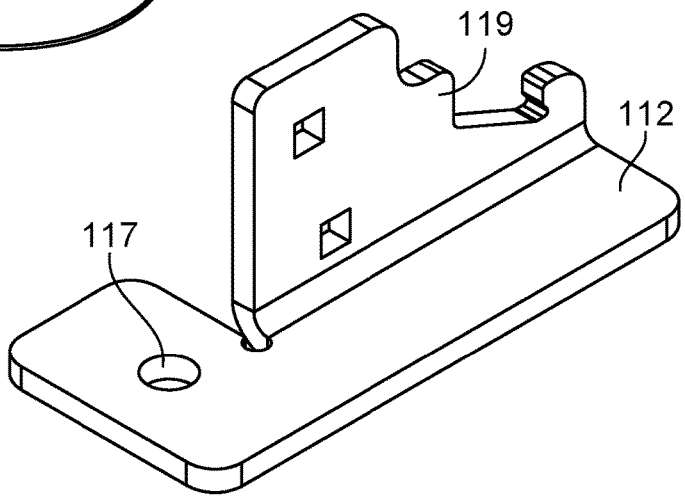
FIG. 34 is a perspective view illustrating the base bracket.
Figure 35A:
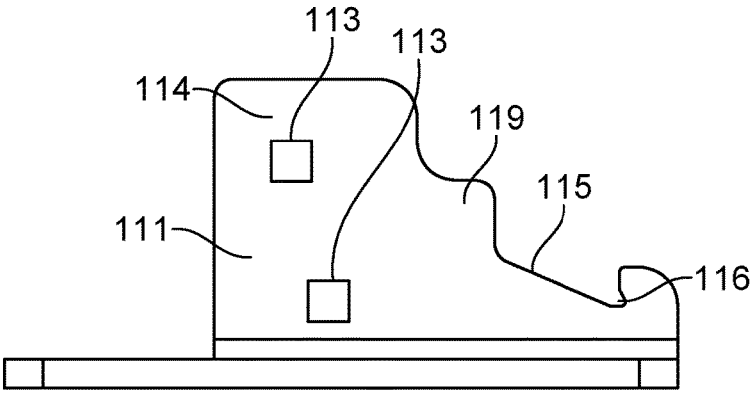
FIG. 35A is a side view illustrating the base bracket.
Figure 35B:
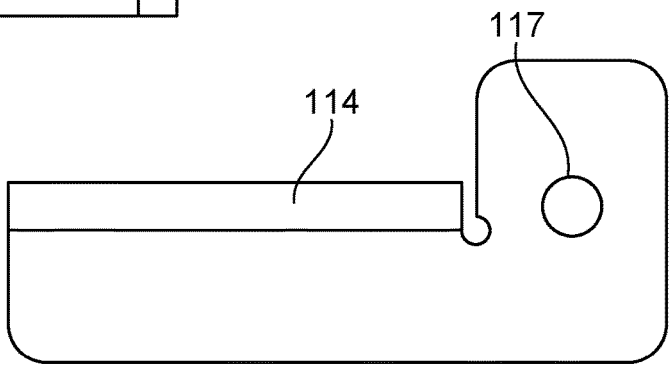
FIG. 35B is a top view illustrating the base bracket.
Figure 36:
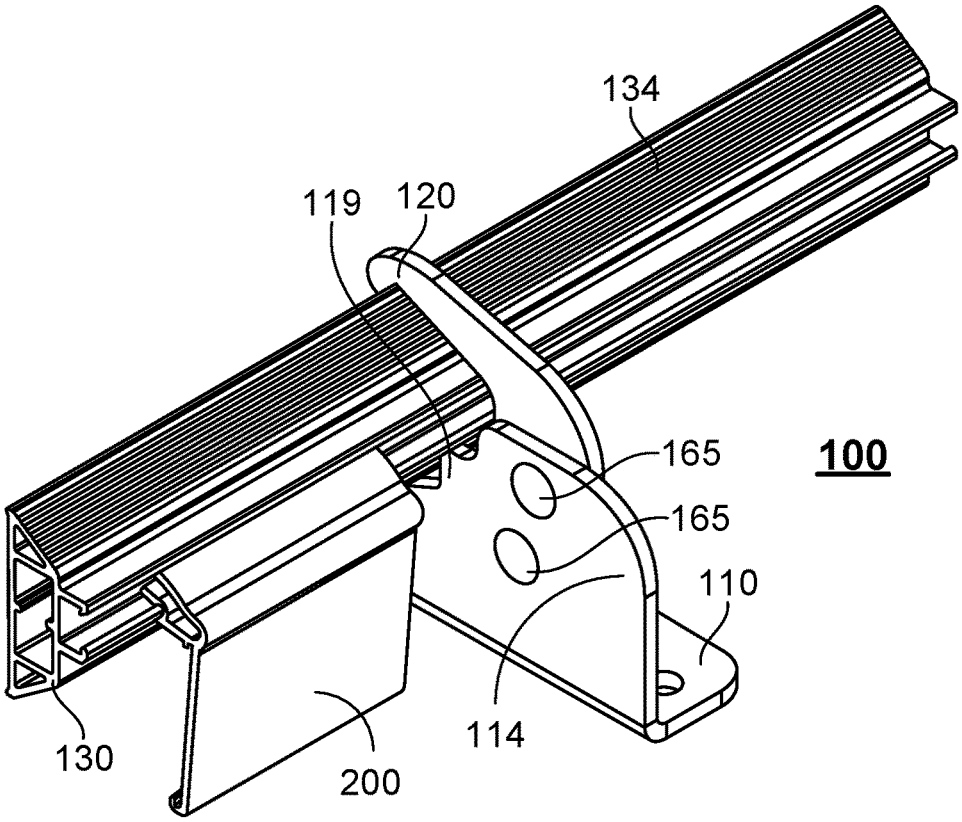
FIG. 36 is a rear perspective view illustrating the bar system and ice flag.
Figure 37:
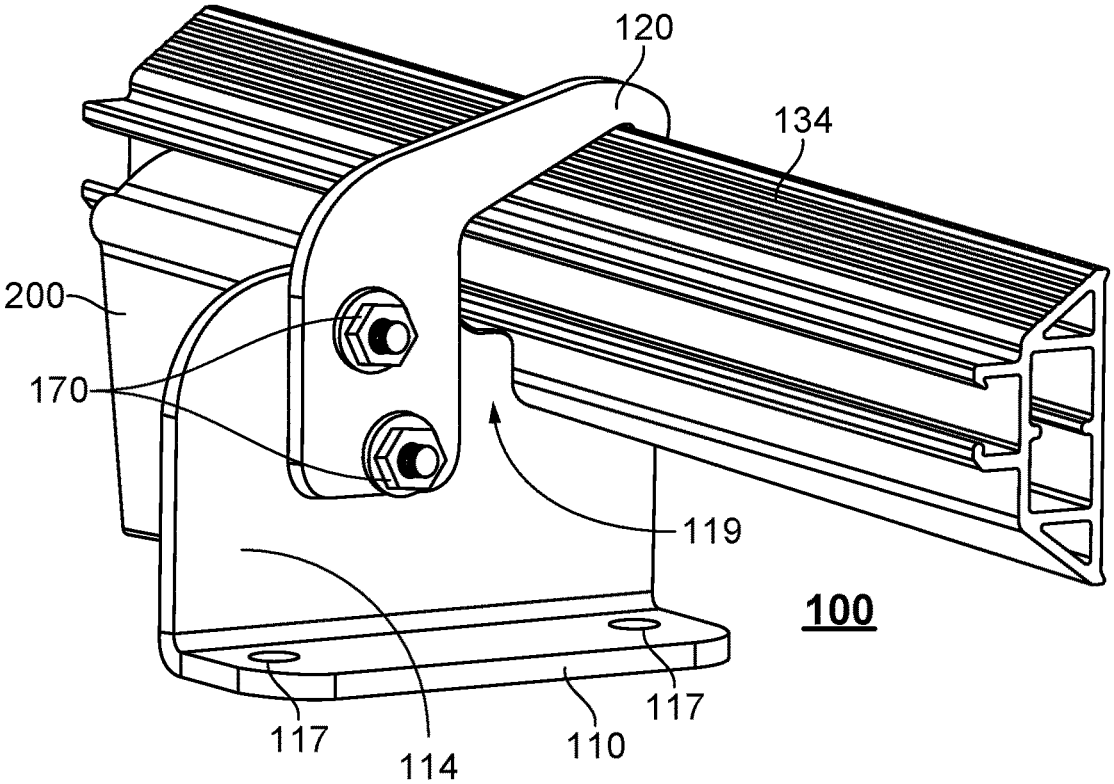
FIG. 37 is a rear perspective view illustrating the bar system and ice flag.
Figure 38:
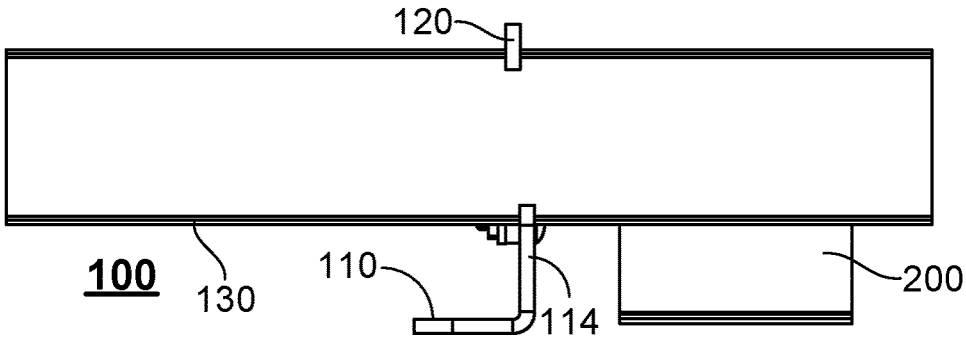
FIG. 38 is a front view illustrating the bar system and ice flag.
Figure 39:
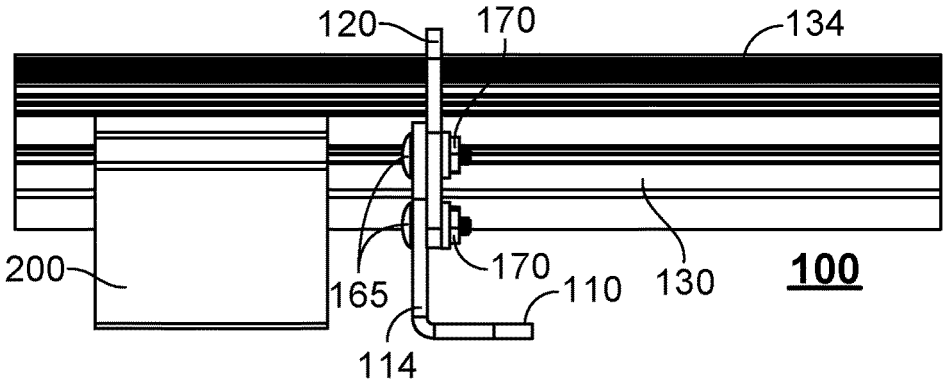
FIG. 39 is a rear view illustrating the bar system and ice flag.
Figure 40:
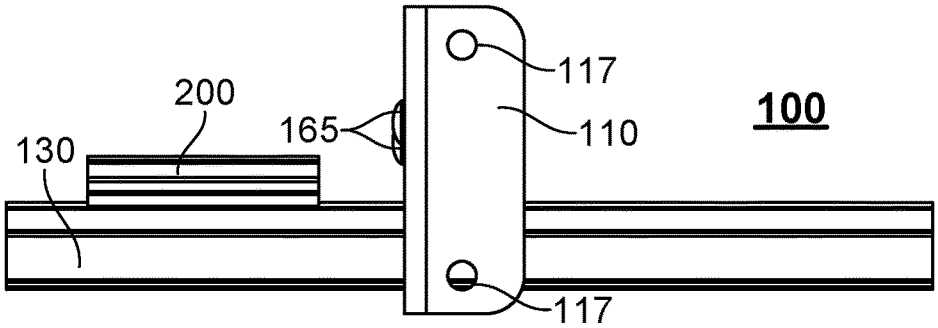
FIG. 40 is a bottom view illustrating the bar system and ice flag.
Figure 41:
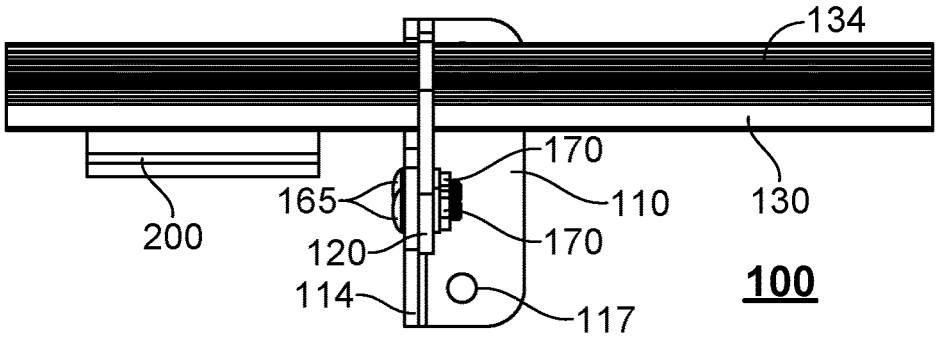
FIG. 41 is a top view illustrating the bar system and ice flag.
Figure 42:
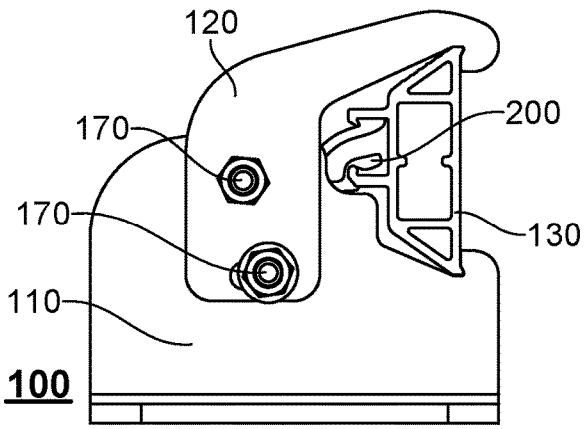
FIG. 42 is a side view illustrating the bar system and ice flag.
Figure 43:
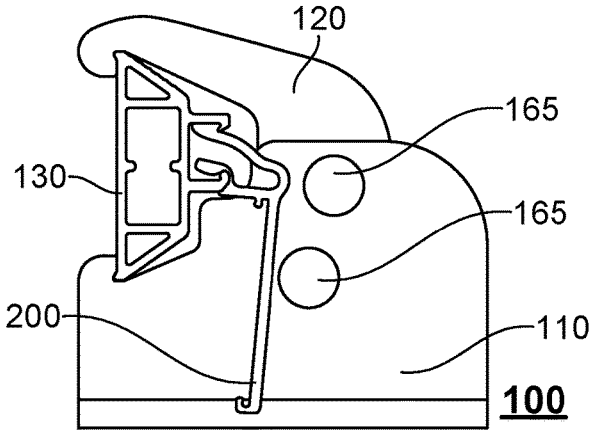
FIG. 43 is a side view illustrating the bar system and ice flag.
Figure 44:
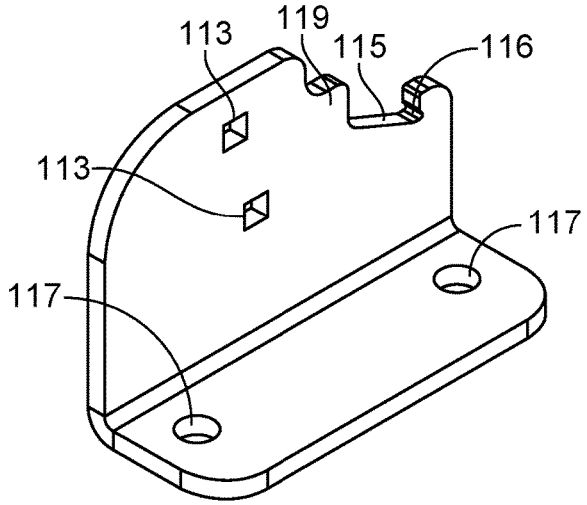
FIG. 44 is a perspective view illustrating the base bracket having square and/or rectangular openings for carriage bolt.
Figure 45:
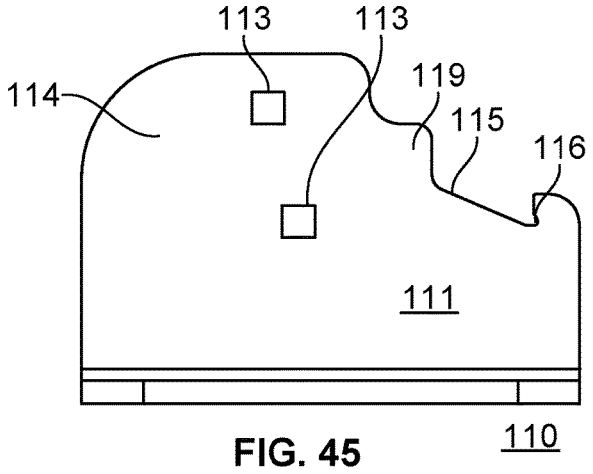
FIG. 45 is a side view illustrating the base bracket having square and/or rectangular openings for carriage bolt.
Figure 46:
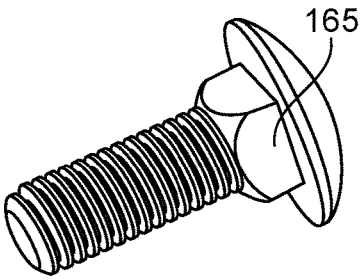
FIG. 46 is a perspective view illustrating the carriage bolt.
Figure 47:
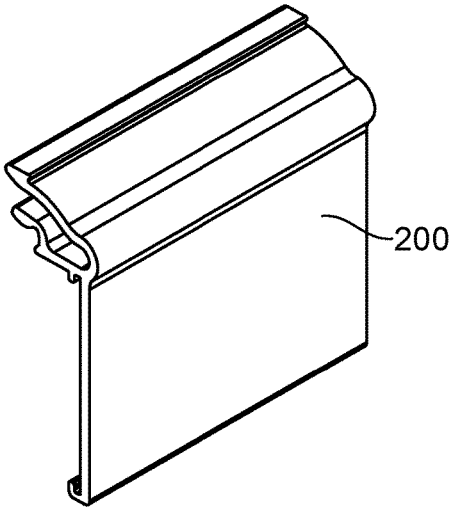
FIG. 47 is a perspective view illustrating the ice flag.
Figure 48:
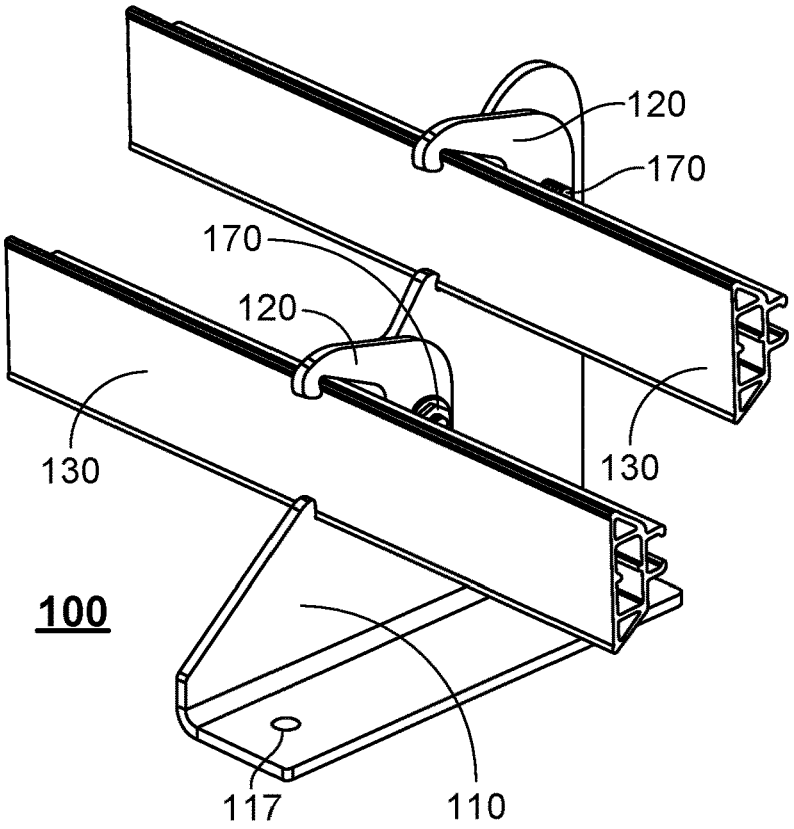
FIG. 48 is a perspective view illustrating an embodiment of the invention having numerous snow bar extrusions.
Figure 49:
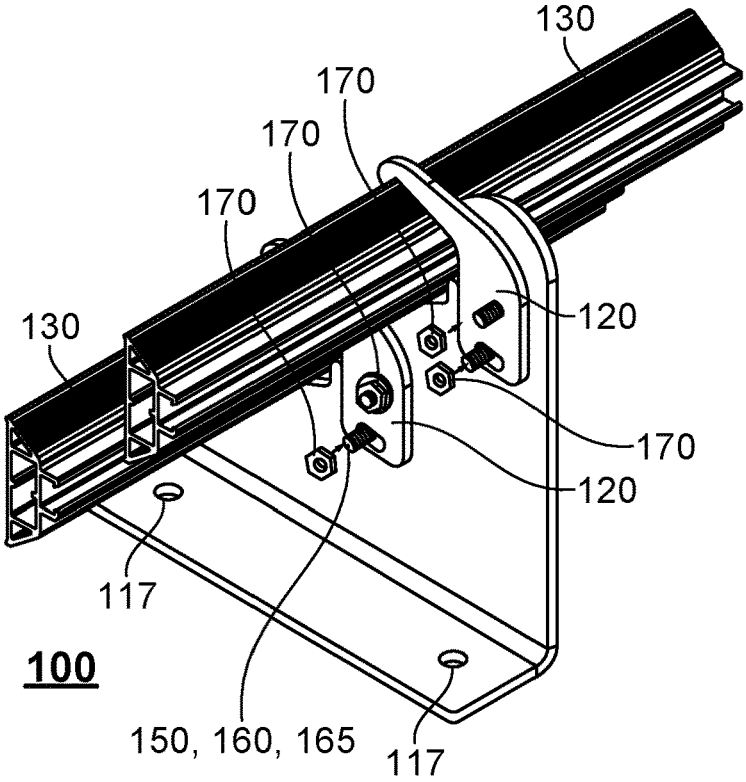
FIG. 49 is a perspective view illustrating an embodiment of the invention having numerous snow bar extrusions.
Figure 50:
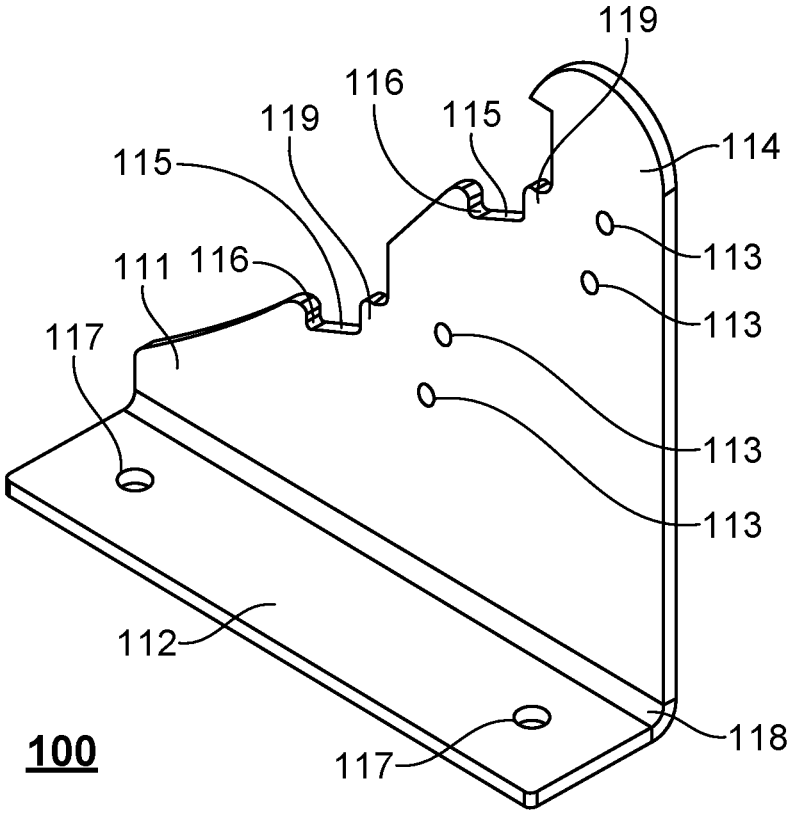
FIG. 50 is a perspective view illustrating an embodiment of the base bracket for numerous snow bar extrusions.
Figure 51:
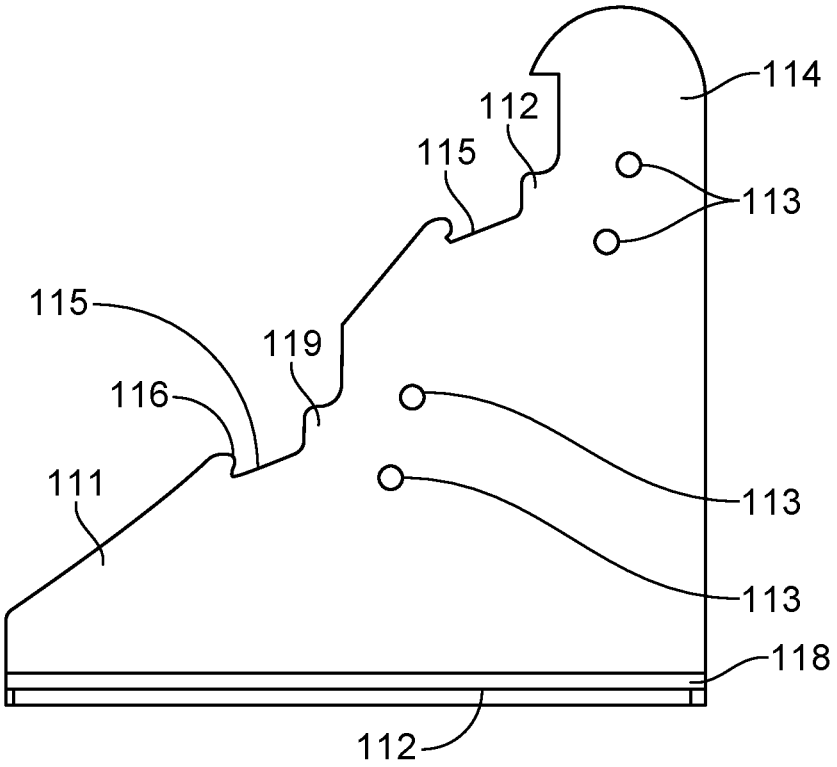
FIG. 51 is a side view illustrating an embodiment of the base bracket for numerous snow bar extrusions.

Referring to FIGS. 1 through 5, the bar system 100 of the invention comprises a base bracket 110 configured for securing to the membrane pad assembly 102 using the threads 164 of a fastener 160. Securing of the bar system 100 may be achieved by threading fastener 160 through the aperture 103 embedded with structure 101, as shown in FIGS. 1-5; however, securing of the bar system 100 may alternatively be achieved by a post 103*a* in combination with the structure opening 117 in the membrane pad assembly 102, as shown in FIGS. 34, and 35A-35B, and then securing the same with a nut 170, as shown in FIGS. 25-31. The base bracket 110 is configured with arm attachment portion 114 to operably connect an arm bracket 120 thereto using one or more fasteners 150 and nuts 170. The snow bar extrusion 130 can be secured between the base bracket 110 and arm bracket 120 so as to form a barrier and/or snow fence for retaining snow, ice and other debris as desired. The stud fastener 150 and nut 170 are utilized to interlock the features of the base bracket 110, arm bracket 120 and snow bar extrusion 130 of the bar system 100. For example, the snow bar extrusion 130 comprises side portions 133, 136 and edges 135, 137 configured to interface and operably connect to slope portions 115, 125 and the cradle portion 116 and the arm cradle portion 126, respectively. The arm bracket also features one or more openings 123 for the stud fasteners 150 and one or more of these openings 123 may be formed as an arcuate opening 127 such that the bar system 100 may have an open position and a close position, for example, the arm bracket 120 may displace along multiple axes such as horizontally, vertically and/or rotationally to allow entry of the snow bar extrusion.

Figure 14:
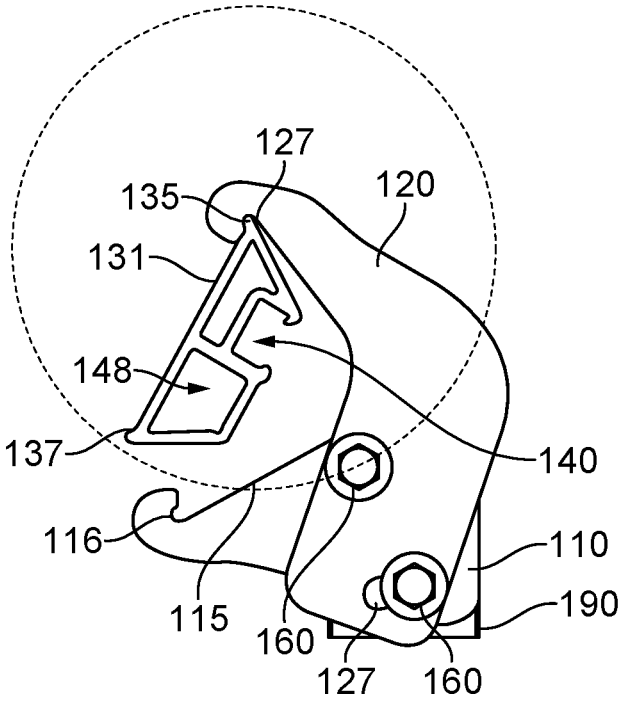
FIG. 14 is a schematic side view illustrating the operation of the bar system in an open position.

As is illustrated in FIGS. 25 through 35A-35B, and according to another embodiment of the invention, a bar system 100 for a membrane pad assembly 102 having a post 103*a* is configured with a base bracket 110 having a ledge 119 formed in an arm attachment portion 114 along with one or more openings 113 configured to receive a carriage bolt fastener 165, and incorporating the same elements described herein. Advantageously, as shown in FIGS. 35A-35B, the ledge 119 incorporated in the base bracket 110 provides a proper insertion of the snow bar extrusion 130, as shown in FIG. 14, to the base bracket 110 and arm bracket 120.

As is illustrated in FIGS. 15, and 36-47, according to another embodiment of the invention, a bar system 100 can be secured to other structures such as a metal roof or other flat portion of a structure using openings 117 in the base bracket 110 to secure to the structure either a fastener 105 or a post 103*a* as described herein. As shown in FIGS. 15, and 36-47, the base bracket 110 comprises a slope 115, a cradle portion 116, and ledge 119 for proper insertion of placement of the snow bar extrusion 130 having openings 113 (e.g. square) for carriage bolt 165. The bar system 100 is configured with a base bracket 110 having a ledge 119 formed in an arm attachment portion 114 along with one or more openings 113 configured to receive a carriage bolt fastener 165, and be secured thereto by the fastener 165 and nut 170, illustrated incorporating the same elements as are described herein. Advantageously, the embodiment shown in FIGS. 15, and 36-47 provides a base bracket 110 that can be secured to the structure. The ledge 119 incorporated in the base bracket 110 provides for proper insertion of the snow bar extrusion 130, according to the arrangement shown in FIG. 14, to be received and operably connected between the base bracket 110 and arm bracket 120.

Similarly, according to another embodiment of the invention shown in FIGS. 48-51, multiple snow bar extrusions 130 can be secured to a tiered, base bracket 110. The base bracket 110 comprises an upper portion 111 having multiple slope portions 115, cradle portions 116, and ledge 119 and openings 113 for the arm attachment portion 114 so as to receive arm brackets 110 secured thereto by fasteners 150, 160, and/or 165 and secured by nuts 170 and further to receive the snow bar extrusion 130 as shown in FIG. 14. In this manner, the bar system 100 can be secured to other structures such as a metal roof or other flat portion of a structure using openings 117 in the base bracket 110 to secure to the structure either a fastener 105 or a post 103*a* as described herein. As shown in FIGS. 48-51, the base bracket 110 comprises a slope 115, a cradle portion 116, and ledge 119 for proper insertion and placement of the snow bar extrusion 130, the base bracket 110 having openings 113 (e.g. square) for carriage bolt 165. The bar system 100 is configured with a base bracket 110 having a ledge 119 formed in an arm attachment portion 114 along with one or more openings 113 configured to receive a carriage bolt fastener 165, and be secured thereto by the fastener 165 and nut 170, as illustrated, incorporating the same elements as are described herein. Advantageously, the embodiment shown in FIGS. 48-51, provides a base bracket 110 that can be secured to the structure, where the ledge 119 incorporated in the base bracket 110 provides for proper insertion of the snow bar extrusion 130, which may be received and operably connected between the base bracket 110 and arm bracket 120.

Figure 6:
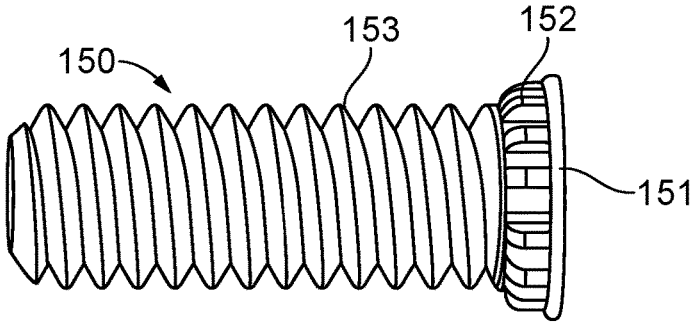
FIG. 6 is a side view of a stud fastener and/or PEM fastener with clinching portions to join permanently to openings in the base bracket.

Referring to FIG. 6, a suitable fastener for securing in the one or more openings 113, 123 and/or arcuate opening 127 of the base bracket 110 and/or arm bracket 120 may be configured as stud fastener 150 of a PEM design. The PEM stud fastener 150 is configured to install permanently in steel or aluminum sheets. These fasteners utilize self-clinching, broaching, flaring, surface mounting, or welding technology, to provide strong, reusable, and permanent threads and mounting points in sheet metal. The fastener 150 comprises a head 151, self-clinching flanges 152, and threads 153 extending along the length of post of the fastener. The self-clinching flanges 152 adjacent the head 151 are designed to become a permanent fixture of the part, component, or device onto which it's installed. Installation is usually performed during the initial fabrication stage or in final assembly of stud fastener 150 to the base bracket 110. Installation may be accomplished by a parallel squeezing force as can be applied by tightening the nut 170 in order to secure the stud fastener 150 to the sheet metal panel of the base bracket 110. The stud fastener 150 is sold under the PEM® brand and manufactured by Penn Engineering & Manufacturing Corp., 5190 Old Easton Rd. Danboro, Pa. 18916.

Figure 7:
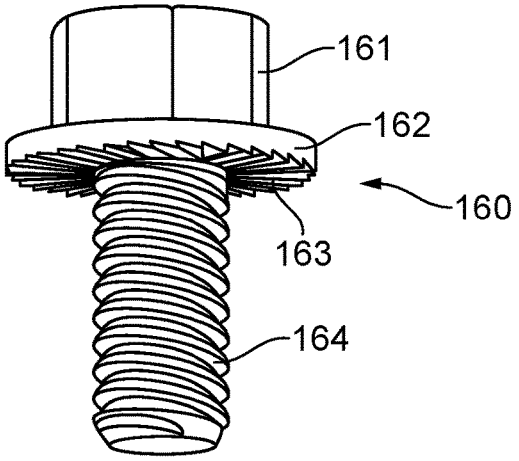
FIG. 7 is a side view of a fastener for use with the bar system.
Figure 13A:
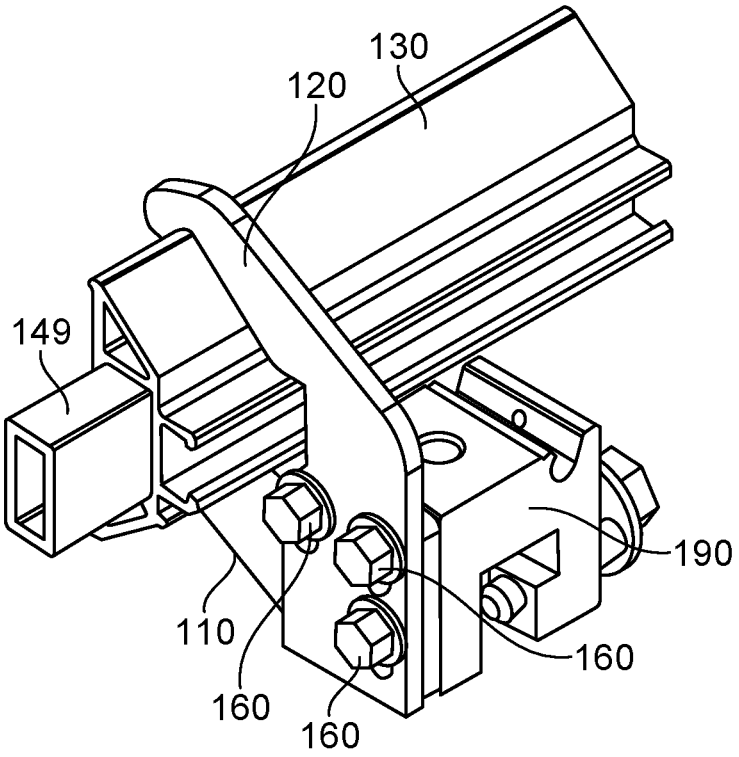
FIG. 13A is a perspective view illustrating the bar system with an ice flag for a mounting clamp.
Figure 13B:
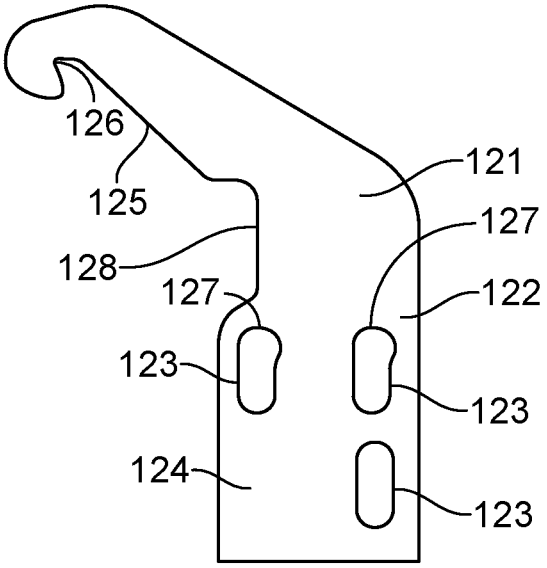
FIG. 13B is a side view illustrating the arm bracket of the bar system for use with the mounting clamp.

Referring to FIG. 7, another suitable fastener for securing components of the bar system 100 comprises a fastener 160 having a head 161, flange 162, self-locking portions on the flange 162, and a threaded shaft 164. The fastener 160 may be utilized to secure the securing the one or more openings 113, 123 and/or arcuate opening 127 of the base bracket 110 and/or arm bracket 120, according to the application for a standing seam metal roof and/or corrugated roof structure, as shown in FIGS. 13A-13B through 16.

Figure 8A:
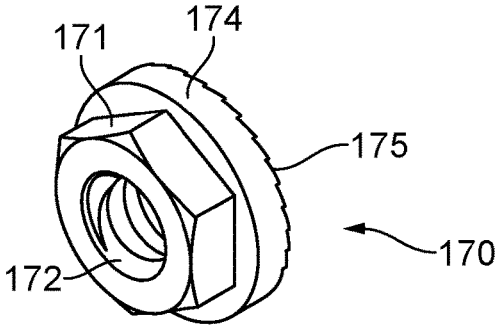
FIG. 8A is a perspective top view and FIG. 8B is a perspective bottom view of a nut for use with the bar system.
Figure 8B:
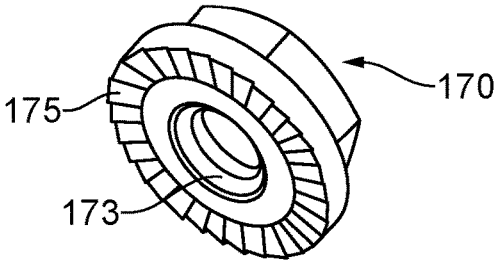

Referring to FIGS. 8A-8B, a suitable fastener of a nut 170 may be used for securing components of the bar system 100, comprising a head 171, an opening 172 having threads 173, and a flange 174 with locking portions 175 disposed on the flange 174.

Figure 9A:
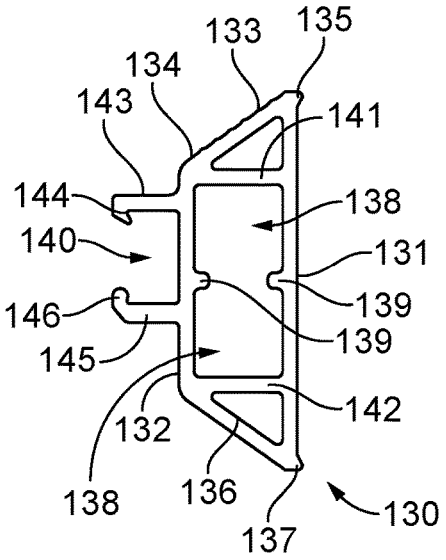
FIG. 9A is a side view illustrating the snow bar extrusion with ice flag channel.
Figure 9B:
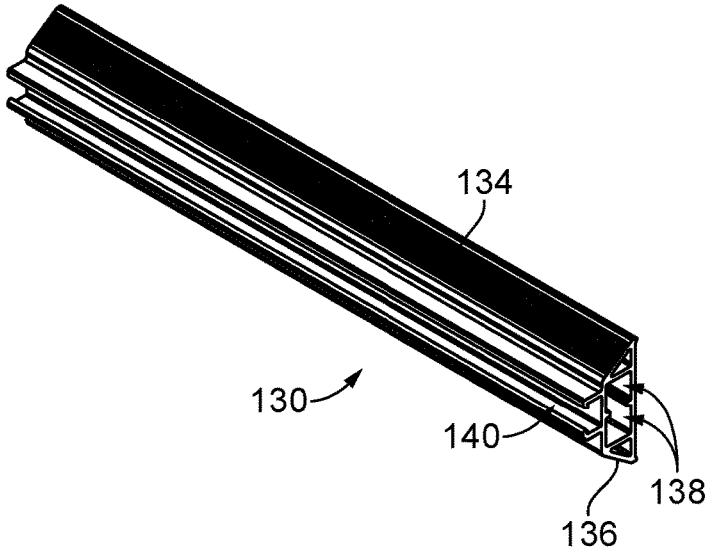
FIG. 9B is a perspective view illustrating the snow bar extrusion.

Referring to FIGS. 9A-9B, the snow bar extrusion 130 for the bar system 100 can be deployed in multiple environments and a variety of configurations of membrane, metal roof, standing seam metal roof, and/or corrugated roof structures. The snow bar extrusion 130 comprises a front portion 131, a rear portion 132, and upper side portion 133 with an upper edge 135, and a lower side portion 136 with the lower edge 137. The upper side portion 133 may further be configured with undulations 134 in the surface providing a resistance force for snow on the upper side portion 133. The undulations 134 also provide the guide to the installer and/or a Poka-yoke (e.g. a Japanese term that means "mistake-proofing" or "inadvertent error prevention") so as to prevent installing the snow bar extrusion 130 in the wrong orientation, to prevent the ice flag 200 from being installed such that it would extend upwardly above the snow bar extension 130. The snow bar extrusion 130 further comprises one or more connector guide channels 138 and/or one or more connector guide separators 139 dimensioned to accept a connector 149, as shown in FIG. 13A. The one or more connector guide channels 138 may be formed between the support beam 141 and a support beam 142 disposed between the front portion 131 and rear portion 132 and adjacent the upper side portion 133 and lower side portion 136, respectively. Triangular structures are formed by the front portion 131, upper side portion 133, and support beam 141 in the snow bar extrusion 130. Similarly, triangular structures are formed by the front portion 131, lower side portion 136, and support beam 142 in the snow bar extrusion 130. Consequently, the snow bar extrusion 130 can have improved strength and long length sections that may be joined in minimal locations between the base bracket 110 and arm bracket 120 in the bar system 100 on the structure 101. In this manner, the coupling parts are reduced, saving cost and installation time, providing an advantage over conventional snow 15 bar systems.

The snow bar extrusion 130 further comprises a snow flag attachment channel 140. The snow flag attachment channel 140 comprises a snow flag upper arm 143 having a tooth 144 disposed at an end thereof and a lower arm 145 having a nub 146 disposed at an end thereof. The tooth 144 is configured to engage and hold securely a portion of the ice flag 200 and the nub 146 is configured to engage and disengage of a portion of the ice flag 200, thereby providing the ability of the ice flag 200 to be removed from the snow flag attachment channel 140.

Figure 10A:
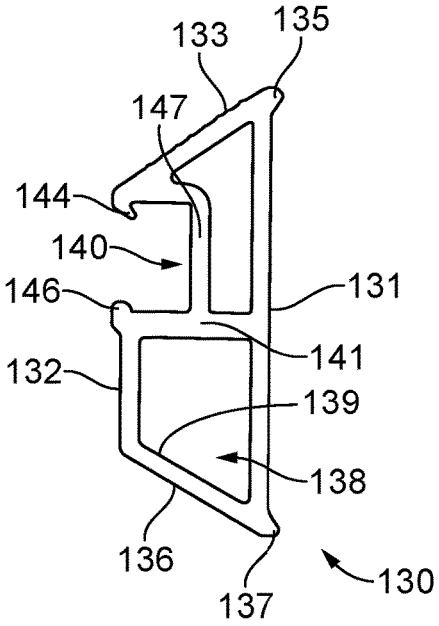
FIG. 10A is a side view illustrating the snow bar extrusion with integral ice flag channel.
Figure 10B:
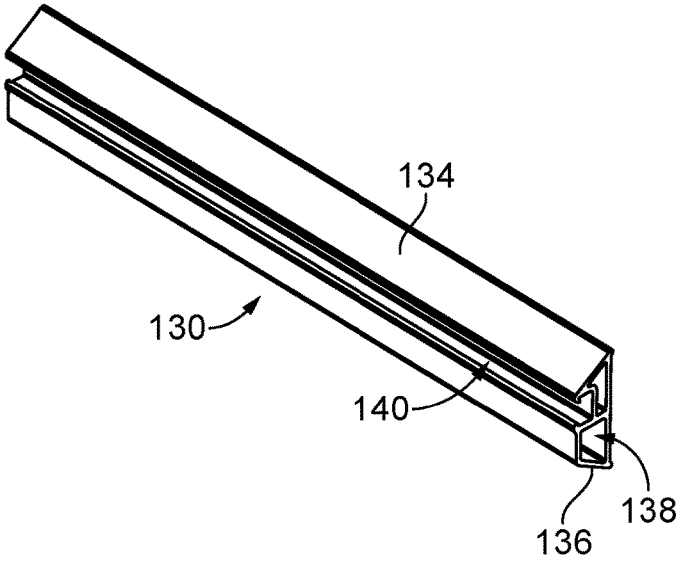
FIG. 10B is a perspective view illustrating the snow bar extrusion.

Referring to FIGS. 10A-10B, in an alternative embodiment the snow bar extrusion 130 for the bar system 100 can be utilized in multiple configurations of membrane, metal roof, standing seam metal roof, and/or corrugated roof structures. The snow bar extrusion 130 comprises a front portion 131, a rear portion 132, an upper side portion 133 with an upper edge 135, and a lower side portion 136 with the lower edge 137. A connector channel 138 is formed between the support beam 141 and the lower side portion 136. The connector channel 138 may further comprise a connector guide separator 139 so as to register the connector 149 in the connector channel 138. A snow flag attachment channel 140 may be formed between the support beam 141 and the upper side portion 133. The support beam 141 extends between the front portion 131 and rear portion 132 having a nub 146 configured on the rear portion 132. An angle arm 147 joins to the support beam 141 and connects to the upper side portion 133, so as to form the snow flag attachment channel 140. The tooth 144 is disposed in the angle arm 147 and upper side portion 133. In this manner, the lower profile snow bar extrusion 130 can be formed that further accepts the ice flag 200.

Figure 11A:
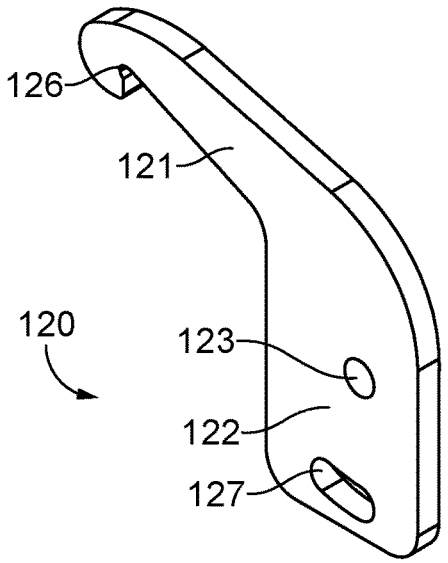
FIG. 11A is a perspective view illustrating the arm bracket.
Figure 11B:
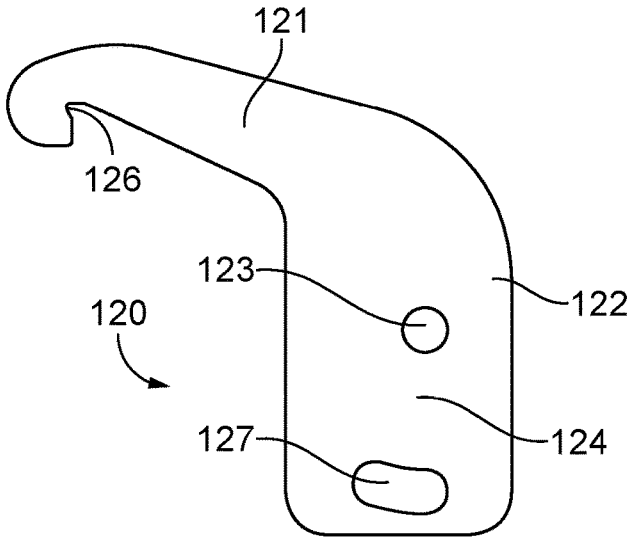
FIG. 11B is a side view illustrating the bar bracket of the bar system for use with mountings of membrane, standing seam and other flat roof structures.

Referring to FIGS. 11A-11B, the arm bracket 120 comprises an upper portion 121, a lower portion 122, one or more openings 123 formed in the lower portion 122 providing a base attachment portion 124. The upper portion 121 further comprises a slope portion 125 generally configured to conform to the profile of the upper side portion 133 of the snow bar extension 130. The upper portion 121 the arm bracket 120 further comprises arm cradle portion 126 configured for securing and holding the upper edge 135 of the snow bar extension 130. The one or more openings 123 formed in the base attachment portion 124 may be configured with an arcuate opening 127 so as to provide access by movement in multiple axis of the arm bracket 120, for example, horizontal and/or rotational movement as shown in FIG. 14. Referring to FIGS. 13A-13B, in an alternative embodiment, the arm bracket 120 can be configured to secure the base bracket 110 to a mounting clamp 190 through one or more openings 123 having an arcuate dimension 127 that provides a vertical displacement. Consequently, horizontal, vertical and/or rotational movement of the arm bracket 130 relative to the adjacent base bracket 110 is configurable, through various embodiments, which provides bar system 100 with the ability to provide opened and closed positions, so as to receive and secure the snow bar extension 130 between the arm bracket 120 to the adjacent base bracket 110, as shown in 11A-11B, 13A-13B and 14.

Figure 12A:
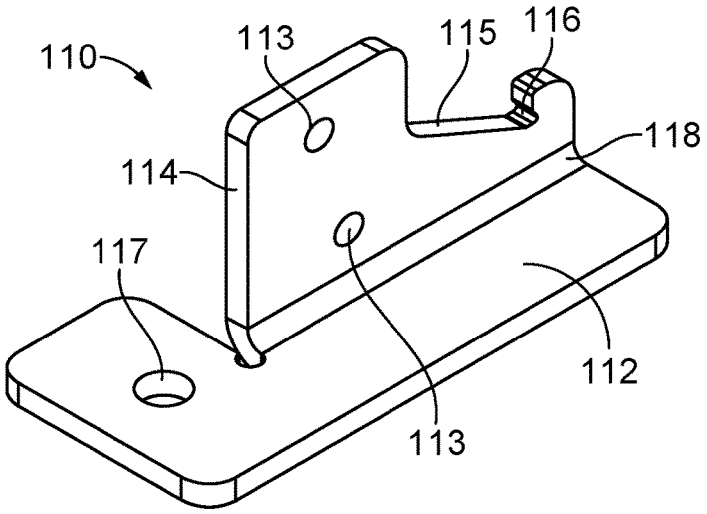
FIG. 12A is a perspective view illustrating the base bracket.
Figure 12B:
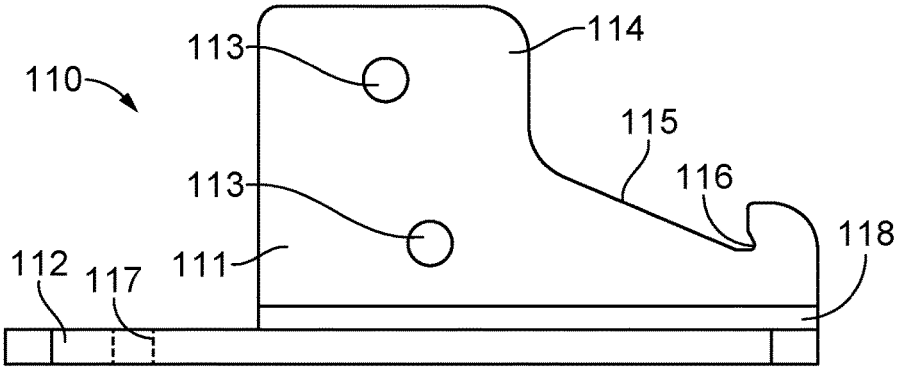
FIG. 12B is a side view illustrating the base bracket of the bar system for use with mountings of membrane, standing seam and other flat roof structures.

Referring to FIGS. 12A-12B, the base bracket 110 comprises an upper portion 111, lower portion 112, and one or more openings 113 formed in the attachment portion 114, which extends vertically from the lower portion 112 by a bend 118 in the material of the base bracket 110. The upper portion 111 comprises the slope portion 115, extending between from the arm attachment portion 114 and a cradle portion 116. The slope portion 115 is generally configured to conform to the profile of the lower side portion 136 of the snow bar extension 130. The upper portion 111 the base bracket 110 further comprises cradle portion 116 configured for securing and holding the lower edge 137 of the snow bar extension 130. The base bracket 110 may further include the structure opening 117 configured to receive the fastener 160 for securing to a membrane pad assembly 102 through its aperture 103, alternatively to receive a post 103*a* thereto from the membrane pad assembly 102 that can be secured by the nut 170. In this manner, the base bracket 110 may be secured directly to the structure 101, thereby providing a stable base to receive and secure the snow bar extrusion 130 in the cradle portion 116 with the arm bracket 120 and fasteners (e.g. stud fastener 150, fastener 160, and nut 170) locking the snow bar extrusion 130 therebetween.

Referring to FIG. 16, a corrugated base bracket 180 comprises similar elements of an upper portion 111 with one or more openings 113, and an arm attachment portion 114, a slope portion 115, and a cradle portion 116. The corrugated base bracket 180 comprises a lower portion 112 operably connected to a joining portion 181 having one or more corrugated stays 182 extending therefrom. The corrugated stays 182 further comprises one or more interweaving portions 183 and one or more other wing portions 184. The corrugated stays 182 are configured to conform to the undulations of the corrugated roofing material on the structure, whereby a fastener may secure through the corrugated stays 182 directly to the structure, thereby securing the base bracket 180 thereto. The arm bracket 120 can be operably connected to the corrugated base bracket 180 using fasteners (e.g. stud fastener 150, fastener 160, and nut 170). In this manner, corrugated base bracket 180 may be secured directly to the structure 101, thereby providing a stable base to receive and secure the snow bar extrusion 130 in the cradle portion 116 with the arm bracket 120 and fasteners (e.g. stud fastener 150, fastener 160, and nut 170) locking the snow bar extrusion 130 therebetween.

Figure 17:
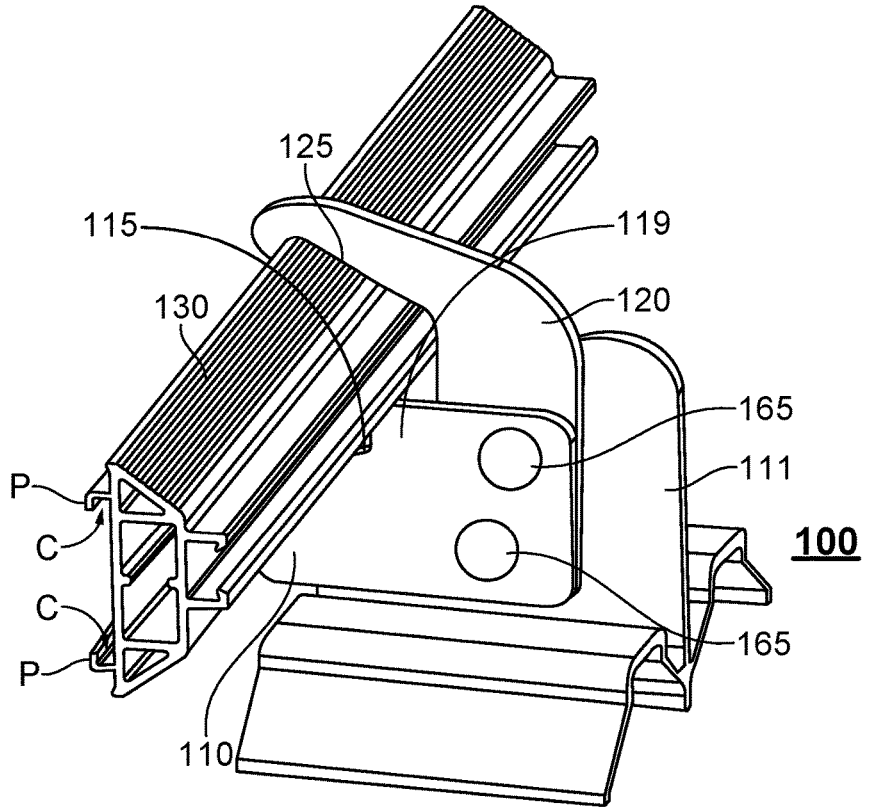
FIG. 17 is a perspective view illustrating the bar system for a corrugated roof.
Figure 18A:
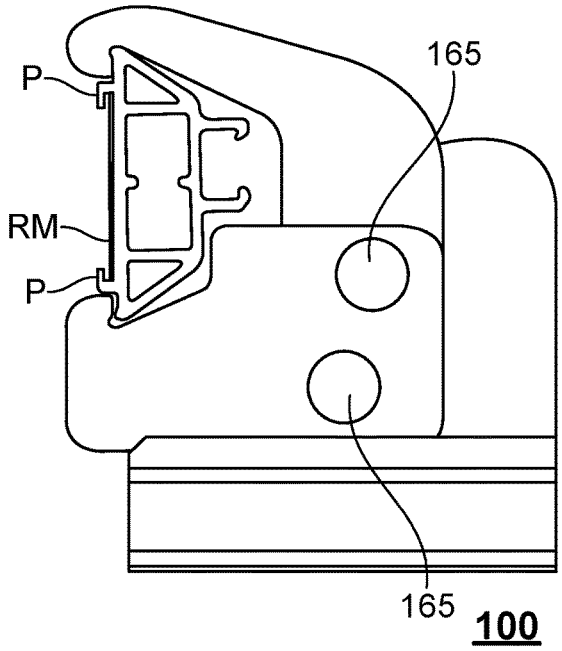
FIGS. 18A and 18B are a side views illustrating the bar system for a corrugated roof.
Figure 18B:
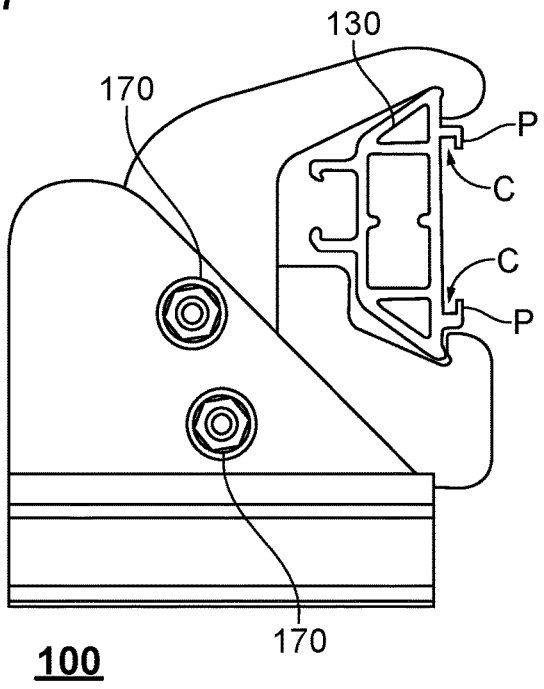
Figure 19:
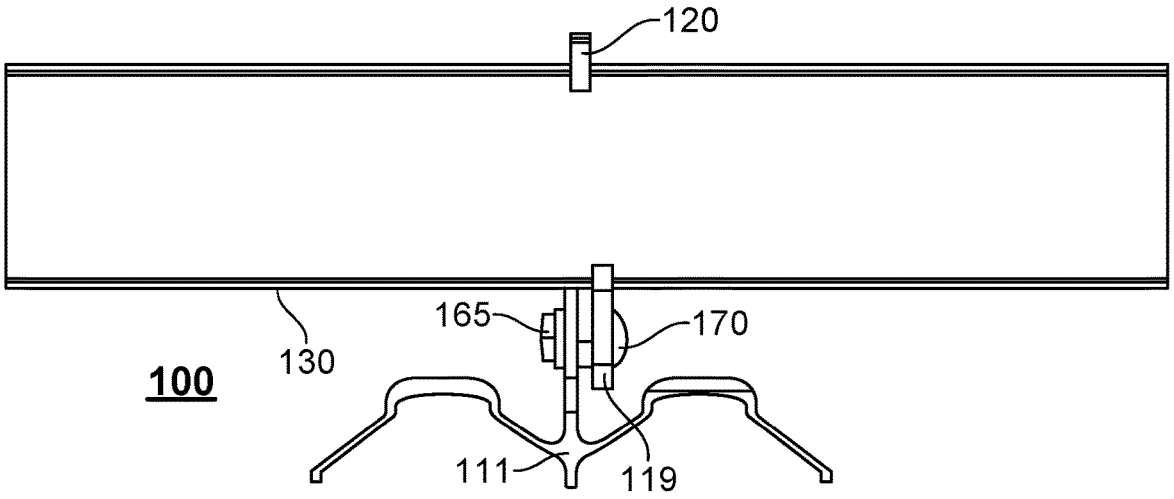
FIG. 19 is a front view illustrating the bar system for a corrugated roof.
Figure 20:
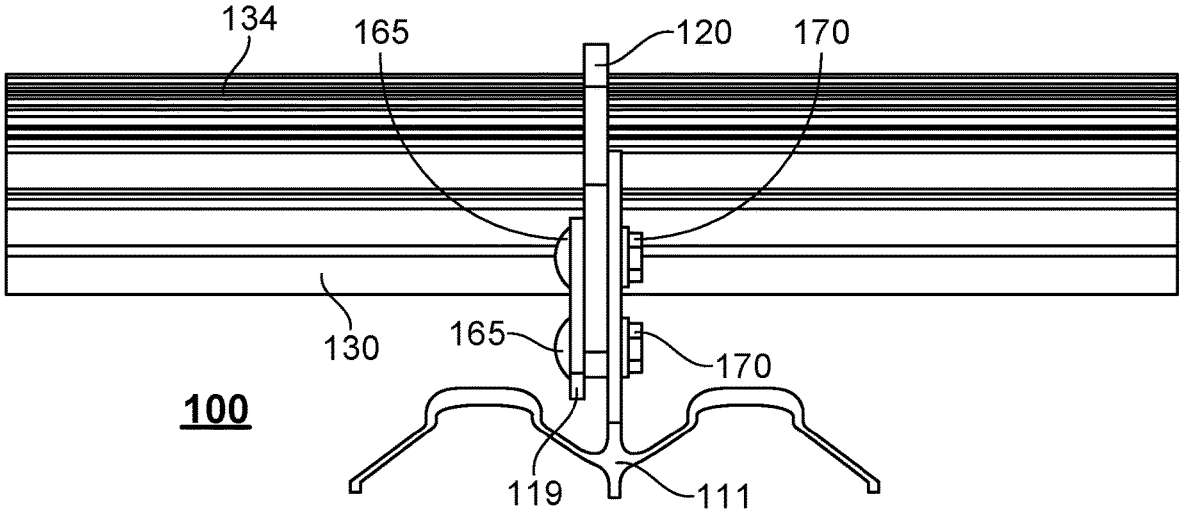
FIG. 20 is a rear view illustrating the bar system for a corrugated roof
Figure 21:
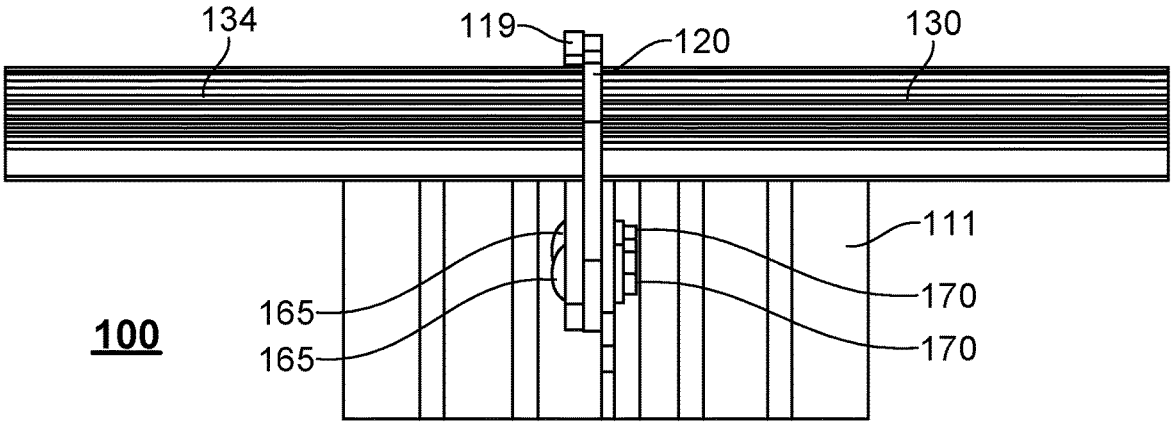
FIG. 21 is a top view illustrating the bar system for a corrugated roof.
Figure 22:
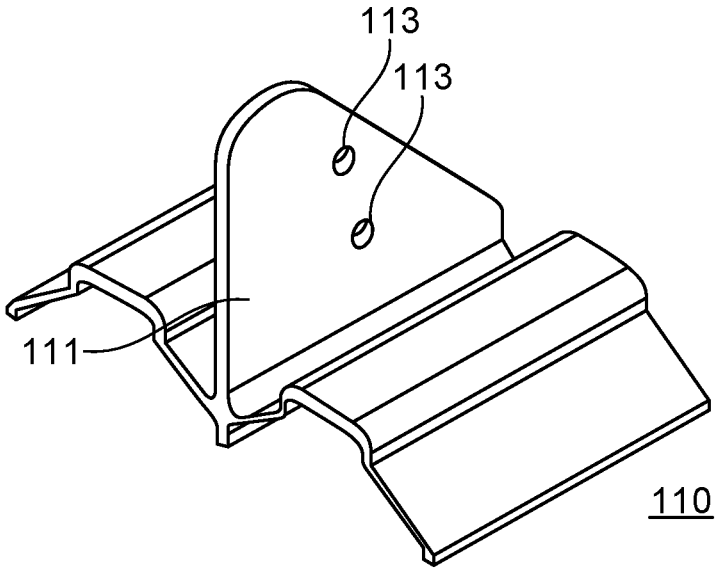
FIG. 22 is a perspective view illustrating the base bracket for a corrugated roof.
Figure 23:
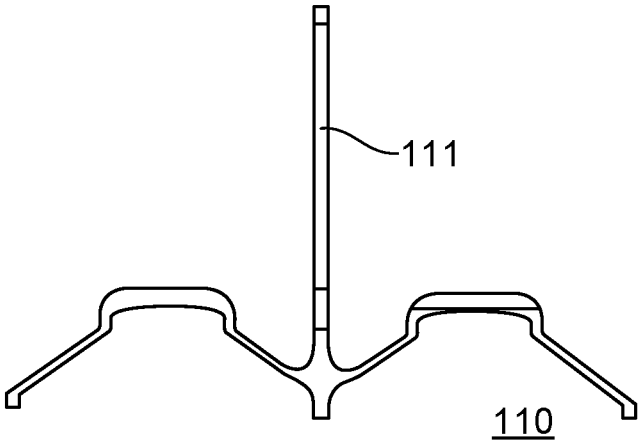
FIG. 23 is an end view illustrating the base bracket for a corrugated roof.
Figure 24:
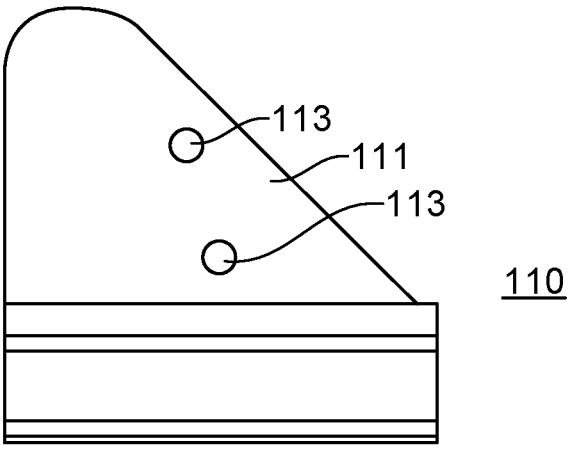
FIG. 24 is a side view illustrating the base bracket for a corrugated roof.
Figure 25:
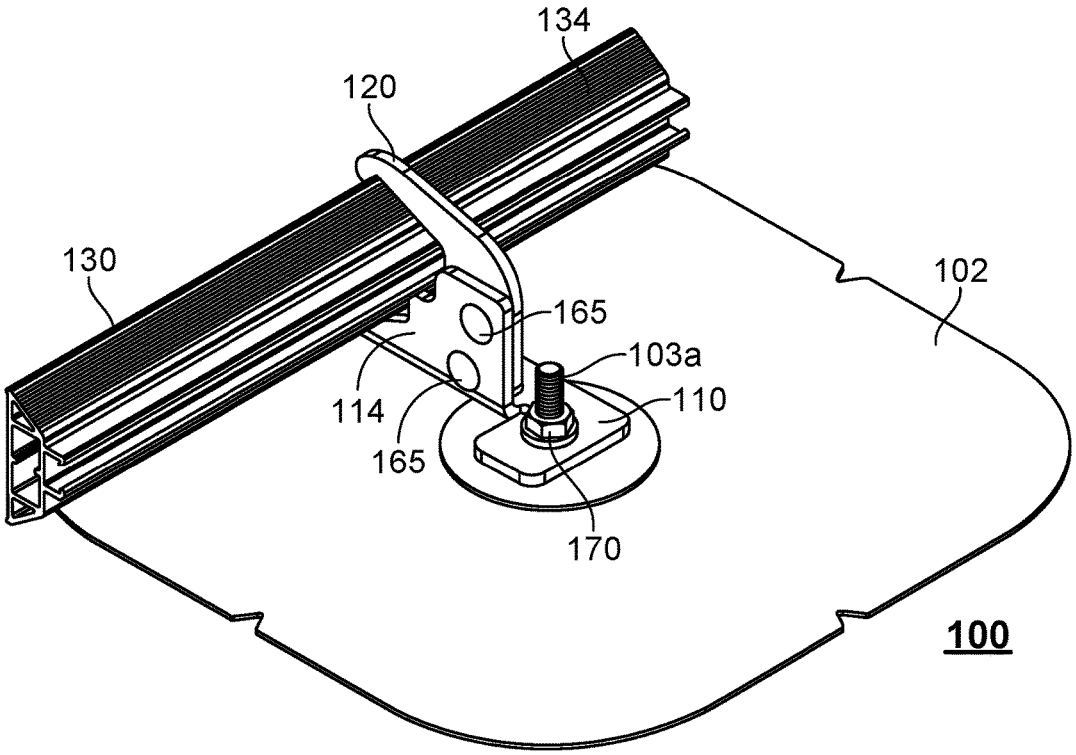
FIG. 25 is a perspective view illustrating the bar system for a membrane roof utilizing a ledge and the carriage bolt fastener.
Figure 26:
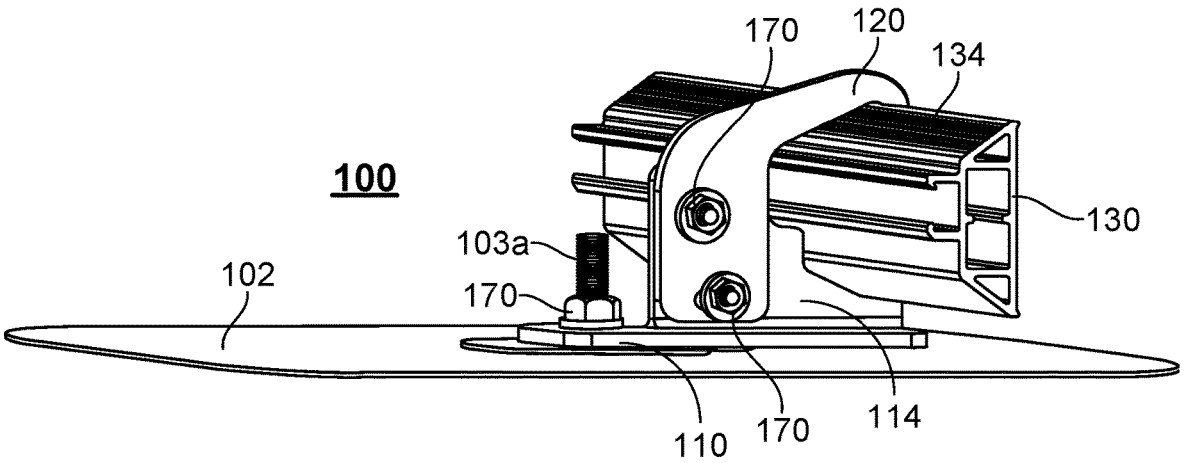
FIG. 26 is a perspective view illustrating the bar system for membrane roof.
Figure 27:
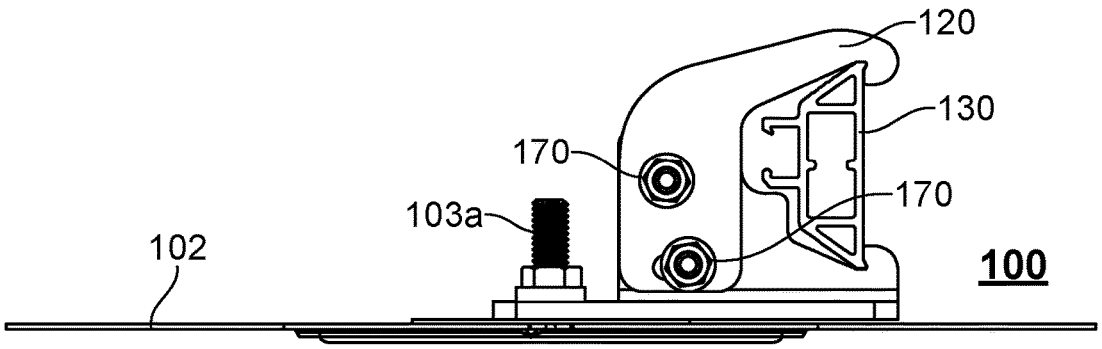
FIG. 27 is a side view illustrating the bar system for a membrane roof.
Figure 28:
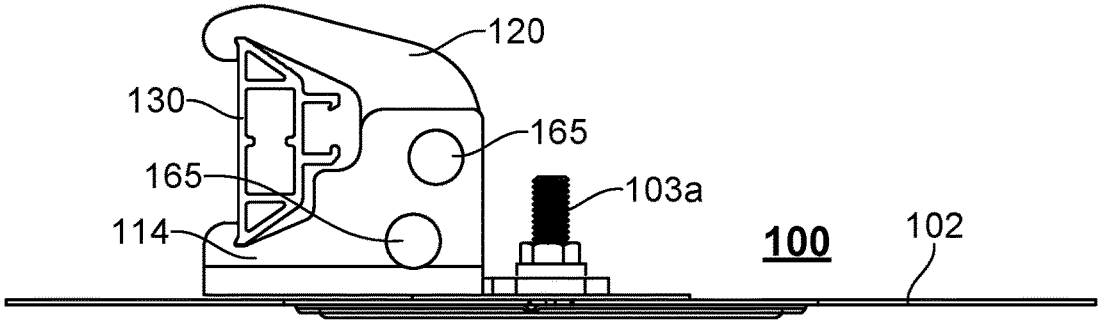
FIG. 28 is a side view illustrating the bar system for a membrane roof.
Figure 29:
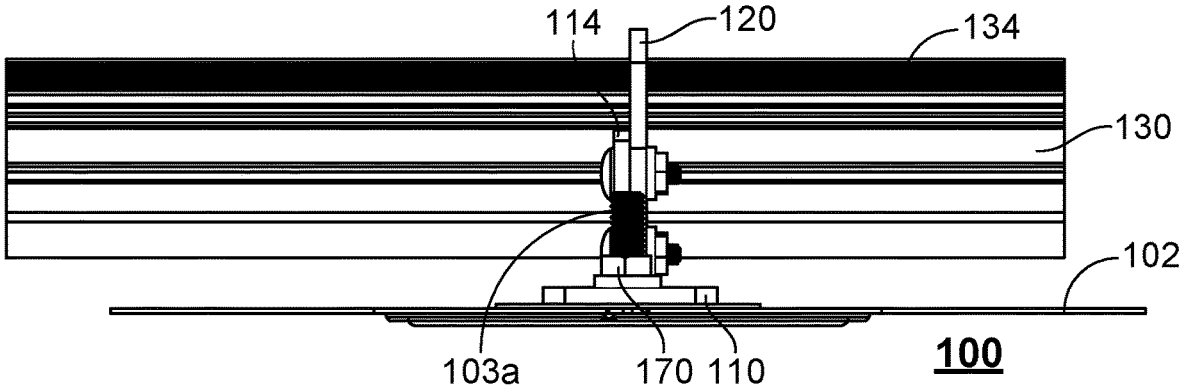
FIG. 29 is a back view illustrating the bar system for a membrane roof.
Figure 30:
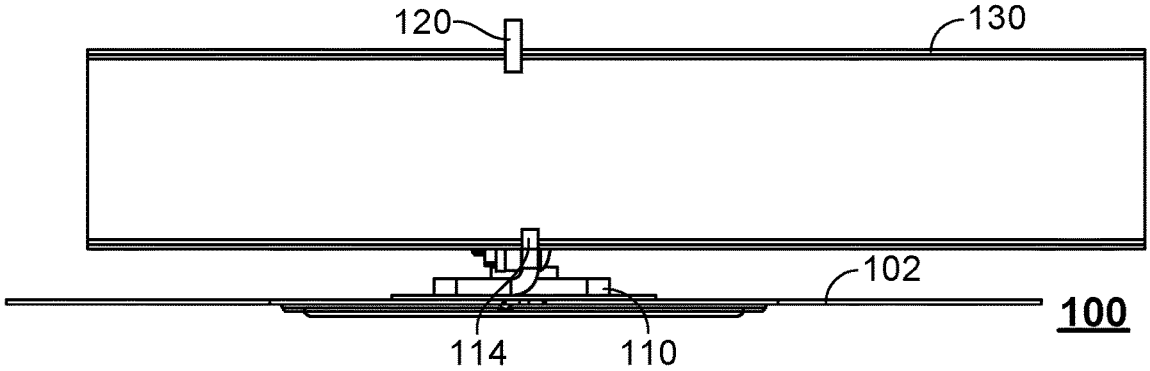
FIG. 30 is a front view illustrating the bar system for a membrane roof.
Figure 31:
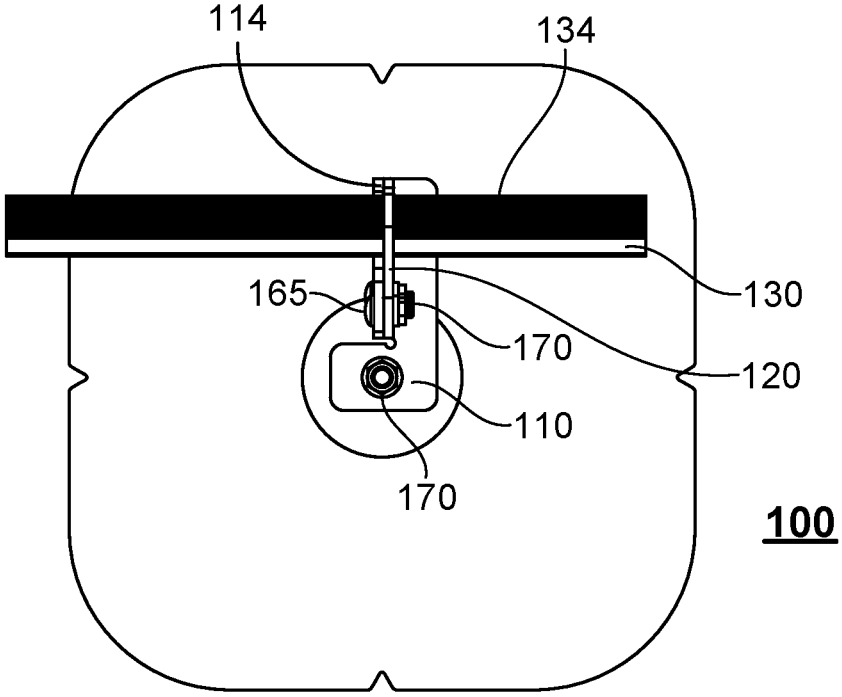
FIG. 31 is a top view illustrating the bar system for a membrane roof.
Figure 32:
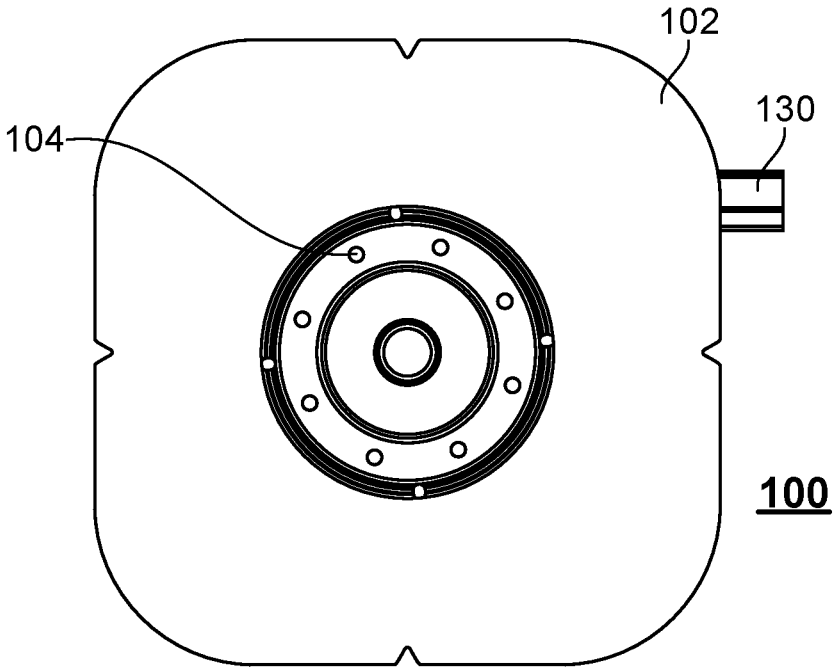
FIG. 32 is a bottom view illustrating the bar system for a membrane roof.
Figure 33:
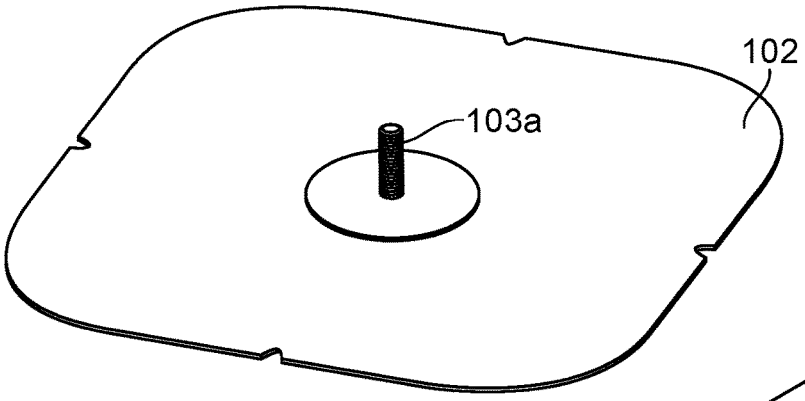
FIG. 33 is a perspective view illustrating a membrane roof pad assembly having a post.

Referring to FIGS. 17-24, according to an alternative embodiment of the invention, the bar system 100 can use an extruded bar 130 having projections P forming a channel Con the face of the extruded bar 130, configured to receive a strip of material or other objects as desired to create a decorative appearance, e.g. matching the color of the structure with roofing material RM or for securing an object such as lights and/or a display to create a decorative appearance. As illustrated in FIGS. 17 and 18A-18B, the bar system 100 is shown in an embodiment for a corrugated roof; however, any of the embodiments for the bar system 100 can use an extruded bar 130 having projections P forming a channel Con the face of the extruded bar 130.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bar system for securing a snow fence to a structure, the bar system comprising:

a base bracket comprising an upper portion and a lower portion, said upper portion including an arm attachment portion, a cradle portion, a slope portion extending therebetween, and at least one opening, said lower portion configured with at least one opening to operably connect said base bracket to the structure;

an arm bracket comprising an arm cradle portion and at least one opening for operably connecting the same to said arm attachment portion using at least one fastener, said arm bracket configured to move relative to said base bracket about said at least one opening between an open position and a closed position; and a bar extrusion comprising a cross-section including a front portion having an upper edge and a lower edge, a back portion offset from said front portion, at least one of each of a support beam and a side portion, each being disposed between said front and back portions, and a snow flag attachment channel extending outwardly from said back portion, said cross-section being linearly extruded to form a length, said bar extrusion configured to be received by movement of said arm bracket to said open position to allow entry of said bar extrusion and attachment of said upper edge to said cradle portion and attachment of said lower edge to said arm cradle portion when said arm bracket is moved to said closed position, said bar extrusion being secured by said fasteners between said arm attachment portion of said base bracket and said arm bracket so as to hold snow, ice and other objects.

2. The bar system of claim 1, wherein said base bracket is selected from the group consisting of clamp, a standing seam clamp, a membrane pad base bracket, a standing seam base bracket, a flat roof base bracket, and a corrugated base bracket.

3. The bar system of claim 1, wherein one of said at least one opening of said arm bracket further comprises an arcuate opening that allows said arm bracket to move along a rotational axis defined by the center of another opening of said at least one opening of said arm bracket.

4. The bar system of claim 1, wherein said at least one opening of said arm bracket further comprises a translational opening that allows said arm bracket to move along a translational axis, said translational axis being selected from the group consisting of a horizontal axis or a vertical axis.

5. The bar system of claim 1, wherein said snow flag attachment channel is configured to receive an ice flag extending downward from said bar extension, said ice flag configured to inhibit snow, ice, and a combination thereof, from sliding off the structure.

6. The bar system of claim 5, wherein said snow flag channel comprises a nub and a tooth configured to operably connect said ice flag to said bar extension such that said ice flag may be attached and removed from said snow flag channel.

7. The bar system of claim 1, wherein said at least one side portion of said bar extrusion forms the hypotenuse of a triangle, said front portion and said support beam each forming sides thereof, said bar extrusion being configured to resist bending upon the introduction of applied forces acting along said length, to said bar system by point loads, distributed loads, and load combinations thereof.

8. The bar system of claim 7, wherein said triangle comprises a right triangle.

9. The bar system of claim 1, wherein said length forms at least one span, said at least one span being defined by a portion of said length disposed between two offset pairs of said base bracket and said arm bracket, said two offset pairs being configured in the closed position and being installed on the structure.

10. The bar system of claim 9 wherein said at least one span is up to about 48 inches in length.

11. The bar system of claim 9 wherein said at least one span ranges from about 6 inches in length to about 48 inches in length.

12. The bar system of claim 1 wherein said bar extrusion further comprises at least one connector guide channel formed between said front and back portions.

13. The bar system of claim 12 further comprising a connector for adjoining two adjacent bar extrusions of said bar system, said connector configured to be received by said at least one connector guide channel of each of said two adjacent bar extrusions.

14. A bar system for securing a snow fence to a structure, the bar system comprising:

a base bracket selected from the group consisting of a membrane pad base bracket, a standing seam base bracket, a flat roof base bracket, and a corrugated base bracket, said base bracket comprising an upper portion and a lower portion, said upper portion including a plurality of arm attachment portions, a plurality of cradle portions, and a plurality of slope portions extending between one of each of said arm attachment portions and said cradle portions, and at least one opening, said lower portion configured with at least one opening to operably connect said base bracket to the structure;

a plurality of arm brackets, each of said arm brackets comprising:

an arm cradle portion; and at least one opening, for operably connecting said arm bracket to said arm attachment portion using at least one fastener, said arm bracket configured to move relative to said base bracket about said at least one opening between an open position and a closed position; and a plurality of bar extrusions, each of said bar extrusions comprising:

a cross-section including a front portion having an upper edge and a lower edge, a back portion offset from said front portion, at least one of each of a support beam and a side portion, each being disposed between said front and back portions, and a snow flag attachment channel extending outwardly from said back portion, wherein said cross-section is linearly extruded to form a length, said bar extrusion configured to be received by movement of one arm bracket of said plurality of arm brackets to said open position to allow entry of said bar extrusion and attachment of said upper edge to said cradle portion and attachment of said lower edge to said arm cradle portion when said arm bracket is moved to said closed position, said bar extrusion being secured by said fasteners between one arm attachment portion of said plurality of arm attachment portions of said base bracket and said arm bracket so as to hold snow, ice and other objects.

* * * * *